US011218808B2

(12) United States Patent
Mettler et al.

(10) Patent No.: US 11,218,808 B2
(45) Date of Patent: Jan. 4, 2022

(54) VARIED CURVATURE DIAPHRAGM BALANCED MODE RADIATOR

(71) Applicants: Ryan Mettler, Kirkland, WA (US); Timothy Whitwell, Kirkland, WA (US)

(72) Inventors: Ryan Mettler, Kirkland, WA (US); Timothy Whitwell, Kirkland, WA (US)

(73) Assignee: Tectonic Fludio Labs, Inc., Woodinville, WA (US)

( * ) Notice: Subject to any disclaimer, the term of this patent is extended or adjusted under 35 U.S.C. 154(b) by 0 days.

(21) Appl. No.: 17/331,582

(22) Filed: May 26, 2021

(65) Prior Publication Data

US 2021/0377665 A1 Dec. 2, 2021

Related U.S. Application Data

(60) Provisional application No. 63/029,857, filed on May 26, 2020.

(51) Int. Cl.

| | |
|---|---|
| ***H04R 1/00*** | (2006.01) |
| ***H04R 7/04*** | (2006.01) |
| ***H04R 7/06*** | (2006.01) |

(52) U.S. Cl.

CPC ..... *H04R 7/045* (2013.01); *H04R 7/06* (2013.01); *H04R 2307/207* (2013.01)

(58) Field of Classification Search

CPC . H04R 7/04; H04R 7/045; H04R 7/06; H04R 2307/207

USPC ..... 381/423

See application file for complete search history.

(56) References Cited

U.S. PATENT DOCUMENTS

| | | | | |
|---|---|---|---|---|
| 7,684,582 | B2 | 3/2010 | Gladwin et al. | |
| 7,916,878 | B2 | 3/2011 | Bank et al. | |
| 7,949,146 | B2 | 5/2011 | McKenzie | |
| 8,391,540 | B2 | 3/2013 | Berriman et al. | |
| 9,426,548 | B2 | 8/2016 | Rayner et al. | |
| 9,525,946 | B2 | 12/2016 | Bank | |
| 9,628,917 | B2 | 4/2017 | Pircaro | |
| 10,051,373 | B2 | 8/2018 | Stahl et al. | |
| 10,177,604 | B2 | 1/2019 | Petersen | |
| 10,623,864 | B2 | 4/2020 | Vieites et al. | |
| 2007/0278033 | A1* | 12/2007 | Bank | H04R 7/10 181/161 |
| 2013/0301866 | A1 | 11/2013 | Bank | |
| 2020/0045424 | A1 | 2/2020 | Imblum | |

* cited by examiner

*Primary Examiner* — Katherine A Faley

(74) *Attorney, Agent, or Firm* — Toussaint L. Myricks

(57) ABSTRACT

Audio device and method for designing and making a diaphragm, the audio device comprising a diaphragm having a curved profile adapted for radiation of audio signals from a plurality of bending modes and a piston mode, one or more of the plurality of bending modes having coincident nodal line locations, the diaphragm having a frontal side and a rear side, and a transducer coupled to the rear side of the diaphragm, the transducer adapted for driving the diaphragm for radiation of audio signals having reduced audio distortion, wherein the plurality of bending modes each have minima locations throughout the diaphragm, and wherein the transducer is mounted on one of the minima locations of the plurality of bending modes and one or more impedance components are mounted on at least one of the remaining minima locations to inertially balance the diaphragm based on a pre-determined relative mean modal velocity limit.

18 Claims, 23 Drawing Sheets

VARIED CURVATURE DIAPHRAGM BALANCED MODE RADIATOR

CROSS-REFERENCE TO RELATED APPLICATION

This application claims priority to U.S. Provisional Application No. 63/029,857, filed May 26, 2020, which is hereby incorporated by reference in its entirety.

FIELD

The present disclosure relates generally to the field of audio systems and, in particular but not exclusively, relates to a curved diaphragm balanced mode radiator and a method of making the same for the reproduction of signals over acoustic frequency ranges.

BACKGROUND

Balanced mode radiators are acoustic loudspeaker transducers that are designed and capable of providing wide directivity, full-range sound across multiple frequency spectrums including bass, treble and mid-range acoustic frequencies and at times ultrasonic frequencies in a single diaphragm audio device. These devices are commonly referred to as BMRs and are often created using flat disks as the diaphragm elements for radiating acoustic energy from vibrations generated by the electromechanical portion of the transducer. These BMR transducers are comprised of multiple inter-operating components that generally include one or more magnets, a pole piece, a steel spacer (in some though not all embodiments), a back plate, a front plate, a coil-former, a voice coil wound onto a portion of the coil-former, a roll surround suspension element and an optional secondary suspension element which is made with corrugated textile, one or more flexible armatures, or an additional roll surround. The coil former is coupled to and extends from a diaphragm into an air gap defined between the outer diameter of the pole piece and the inner diameter of the front plate. The portion of the coil former upon which the voice coil is wound is placed in the air gap in a location proximate to the magnets and the pole piece such that the voice coil is placed within a radially directed, static magnetic field that extends between the pole piece and the front plate. In practice, the static magnetic field in the air gap interacts with a time-varying alternating current signal flowing within the voice coil used for transmission of an audio signal. The interaction between the static magnetic field and alternating current signal produces an electrodynamic force that, according to Lorentz's law, acts at right angles to the direction of the flowing current and the direction of the static magnetic field to drive the motion of the diaphragm connected to the coil former based on the time-varying audio signal flowing through the voice coil. This driving motion of the diaphragm causes a BMR to radiate acoustic energy (e.g., audio sound waves).

One of the more significant distinctions between a BMR and a conventional drive unit, commonly referred to as an "audio transducer," relates to the intended vibrational behavior of the diaphragm. The diaphragm in a conventional drive unit is largely intended to vibrate as a rigid structure, avoiding structural standing waves, often referred to as "bending modes" that are considered undesirable due to their largely uncontrolled nature. On the other hand, the diaphragm in a BMR drive unit is intended to vibrate both as a rigid structure and through the intentional use of multiple bending modes within the desired signal band, with the outputs from both vibrational schemes complementing each other. The vibrational frequencies of these bending modes can vary depending on the size of the speaker diaphragm, the materials from which the diaphragm is constructed, and the mechanical impedance of any components connected to the diaphragm. In a BMR, the acoustic energy radiated from these vibrational bending modes sum together in a complex manner and with energy radiated by a pistonic motion of the diaphragm. However, in a BMR the acoustic energy from the vibrational bending modes contributes little or no net radiation on-axis. Each bending mode is characterized by the number of nodal lines (concentric circles for a circular diaphragm) across the diaphragm at that particular mode. A nodal line is defined as a region of the diaphragm that does not undergo translational motion from modal excitation (i.e., in a direction normal to the plane of the diaphragm) at that particular mode frequency even though pistonic motion still occurs at such nodal line. An alternative, though complementary, definition of a nodal line is that it is a minimum point in the mechanical admittance function of a diaphragm when plotted from the center to the edge of the diaphragm at a particular mode frequency (called an "eigenfrequency"). Examination of the mechanical admittance function for a particular bending mode shows that an Nth-order bending mode is characterized by having N nodal lines (N-minima in the mechanical admittance function) across a diaphragm.

In mechanical systems such as loudspeaker diaphragms, mechanical admittance is the inverse of mechanical impedance and it quantifies how readily force may be transformed into velocity when applied to a system. A mechanical admittance function defines the value of mechanical admittance at each location on the diaphragm from the center to the edge of the diaphragm based on an axisymmetric geometry. Mechanical admittance functions for non-axisymmetric diaphragm geometries are defined relative to their respective geometries. An analysis of mechanical admittance at the eigenfrequencies of a diaphragm is beneficial because mechanical resonance is accompanied by high mechanical admittance. Furthermore, the total mechanical admittance at each individual eigenfrequency is comprised of a combination of its eigenmode shape, all lower frequency bending mode shapes, and the mechanical admittance of the pistonic mode. When the admittance of the pistonic mode is subtracted from the total mechanical admittance, the modal mechanical admittance is the result. The modal mechanical admittance is comprised of only bending mode shapes. In practice, the physical manifestation of an eigenmode shape is a shape function. The shape function represents the displacement, velocity, or acceleration form of the eigenmode at that eigenfrequency. Generally, the modal mechanical admittance function of the highest eigenfrequency in the used bandwidth should be analyzed which is typically the third or fourth bending mode. The shape functions of lower order bending modes are de-emphasized as their eigenfrequencies increasingly differ from the observed eigenfrequency. For example, the mechanical admittance of the pistonic mode is halved with each increasing frequency octave. Other eigenmodes have varying rates of decreasing mechanical admittance above and below their respective eigenfrequencies.

The mechanical admittance functions of all the bending modes that occur within the target bandwidth of the device are determined, typically through finite element analysis. These in-band mechanical admittance functions of bending modes are combined in a weighted sum to determine positions of minimum modal mechanical admittance for the highest utilized bending mode and this modal mechanical admittance function is generally dominated by the highest bending mode considered in the sum. These positions of minimum modal mechanical admittance define prescriptive locations where the voice coil former and corresponding inertial balancing mechanical impedance elements can be mounted to a diaphragm. Mechanical impedance elements are components comprising mechanical properties of mass, stiffness, and damping. Inertial balancing is the process where these mechanical impedance elements are attached to the diaphragm at prescribed locations to compensate for the necessary addition of the force input components, comprising the voice coil assembly. In an inertially balanced device, such as a BMR, the radiation from all of the bending mode vibrations sums in such a manner so as to produce zero, or approaching zero, net on-axis acoustic radiation.

As a general matter, any of the minima of the modal mechanical admittance function may be used to attach the voice coil former, and the remaining locations used to attach the mechanical impedance elements for inertial balancing. Commonly, the outermost (i.e., largest diameter) location is where a roll surround suspension element is attached. In all electrodynamic type drive units this roll surround element is effectively a necessity, providing a secondary plane of suspension for the motion of the moving parts, and creating an air seal to prevent pressure equalization (i.e., cancellation) around the edge of a diaphragm. Therefore, by using a roll surround as the outermost balancing impedance element, the number of required components attached to a diaphragm can be minimized. This is desirable from a cost and ease of assembly perspective.

A form of distortion may be caused if the drive location coincides with a region of the diaphragm that exhibits relatively high modal velocity thereby generating an electromotive force through the motor structure that opposes the drive force, resulting in a reduced acoustic output at the frequency corresponding to this bending mode. Positioning the attachment of the coil former to the diaphragm at the location of the nodal line of a bending mode significantly reduces the excitation of the mode, and thus reduces or eliminates the associated modal velocity at the drive location. If a BMR drive unit with the lowest possible distortion is to be created, an optimal location exists at which the voice coil former element should be attached to the diaphragm. This location is specific to an implementation where bending modes up to the fourth bending mode are being inertially balanced. In this configuration (colloquially referred to as a "four-mode-balance") the third modal mechanical admittance minimum (close to the third nodal line of the fourth bending mode counting radially outwards from the center of the diaphragm) of the four total minima is used as the location for the voice coil former. This location is optimal due to the close intersection of the minima of the mechanical admittance function of the first bending mode which occurs at 68% of the diaphragm diameter and the third minima of the modal mechanical admittance function of the fourth bending mode (third nodal line of the fourth bending mode), which occurs at 69% of the flat, circular diaphragm diameter.

Although this configuration is known to reduce or eliminate distortion associated with high velocity motion of the first bending mode in a BMR, there is a substantial commercial downside and a problem of growing concern in that the required voice coil former must have a diameter that is 69% of a flat, circular diaphragm's diameter. The requirement for voice coil formers with diameters of this relative size limits radial space available for a secondary suspension component and often prevents the use of ceramic magnet types due to their large volume which are required outside the coil diameter. The requirements for a voice coil former of this size necessarily results in a large, heavy motor assembly in which the magnets and metalwork represent the bulk of the cost and weight of the drive unit. Therefore, a significant and growing need exists for an improved BMR design that can deliver low distortion output while utilizing voice coils, and therefore associated magnets and metalwork, with reduced cost.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

In the description to follow, various aspects of embodiments of radiating diaphragms for balanced mode radiators will be described, and specific configurations will be set forth. Numerous and specific details are given to provide an understanding of these embodiments. The aspects disclosed herein can be practiced without one or more of the specific details, or with other methods, components, systems, services, etc. In other instances, structures or operations are not shown or described in detail to avoid obscuring relevant inventive aspects.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification do not necessarily all refer to the same embodiment. Furthermore, particular features, structures, or characteristics may be combined in any suitable manner in one or more embodiments.

Figure 1:
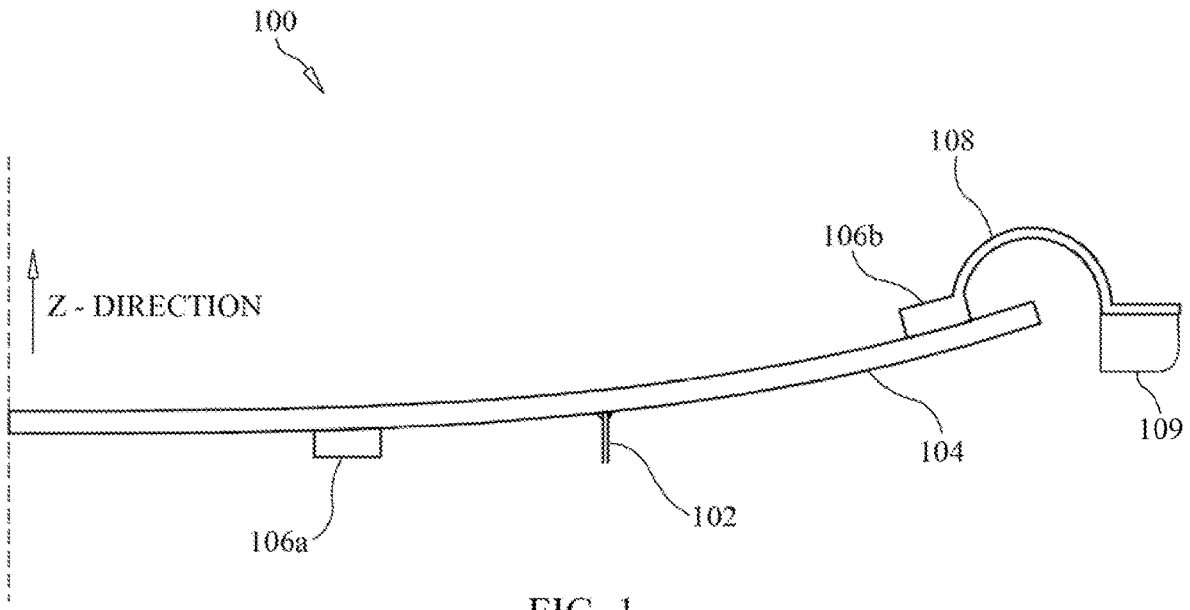
FIG. 1 is an axisymmetric cross-sectional view of a curved diaphragm balanced mode radiator in an embodiment.

FIG. 1 is an axisymmetric cross-sectional view of an embodiment of a balanced mode radiator (a "BMR") having a curved diaphragm that is adapted for radiating acoustic signals over audio and ultrasonic frequency ranges. The BMR 100 is comprised of a diaphragm 104, multiple impedance components 106*a*, 106*b*, a roll surround suspension element 108 which is mechanically grounded to a frame 109 and a coupler 102 (usually a voice coil former but may at times include an additional component) for energy transmission from an electromechanical transducer into a rear side of the diaphragm 104. The curved shape of the diaphragm 104 of the BMR enables the generation of desired bending modes of the diaphragm 104 that transmit signals in a Z-direction normal to the surface of the diaphragm at its center. In alternative non-circular embodiments of a BMR, the Z-direction can be identified as the direction of a moving diaphragm 104 during pistonic operation when a voltage is applied to a voice coil. In the curved diaphragm BMR design, the curved shape of a diaphragm is manipulated both in simulation and in physical form to produce acoustic output signals with desirable properties in terms of radiated bandwidth, signal frequency, directivity, sound pressure level, low distortion, and output signal acoustic power response.

Figure 2:
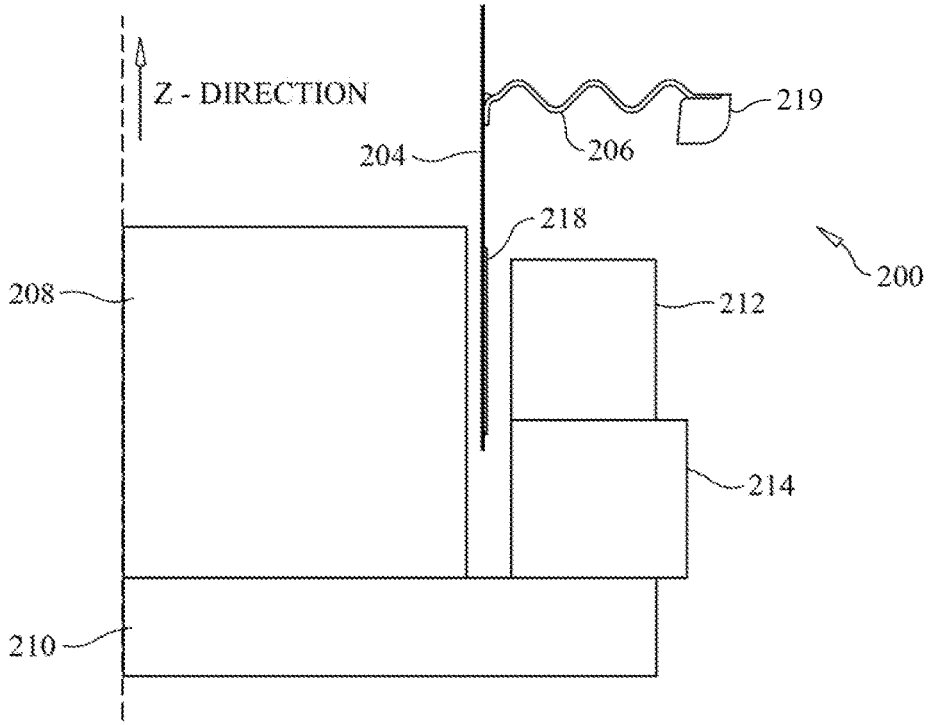
FIG. 2 is an axisymmetric view of an electromechanical transducer for driving a balanced mode radiator diaphragm in an embodiment.

FIG. 2 is an axisymmetric view of the operative components of an electromechanical transducer 200 in an embodiment. In the illustrated embodiment, the transducer 200 is comprised of a voice coil former 204 that is coupled on its upper portion to the rear side of a diaphragm (not shown), an electrical wire, referred to as a voice coil 218, that is wound upon the lower portion of the voice coil former 204, and a corrugated suspension element 206 (referred to as a "spider"). The spider element 206 is connected at one end (its inner radius) to a location on the upper portion of the voice coil former 204 and on an opposite end (its outer radius) to the stationary frame 219 of a BMR. The spider element 206 and roll surround suspension element 108 work together to provide a restoring force to a moving assembly to keep the voice coil 218 positioned in a gap. If the radial width of the spider element 206 is small, then the restoring force will rise too quickly as the moving assembly moves away from a rest position which will cause harmonic distortion to be generated. The moving assembly in this case is the assembly comprising a diaphragm, roll surround (apart from the outer portion fixed to the stationary frame of a BMR), the voice coil 218 and voice coil former 204 assembly, any impedance components, and the spider (apart from the outer portion that is fixed to a stationary frame for a BMR), plus any adhesives used to bond these parts and the lead out wires extending from the voice coil to connectors on the frame of a BMR.

The voice coil 218 carries an electrical signal representing an audio signal of a given desired input. As an electrical signal is conducted through the voice coil 218, an electromotive force is generated from the electromagnetic interaction coupling between a static magnet field and the electrical signal flowing through the voice coil 218. This electromotive force is a driving force that acts on the voice coil 218 and is coupled through the voice coil former 204 (upon which the voice coil 218 is wound) to the rear side of the diaphragm which in turn produces a pistonic acceleration (i.e., a piston mode) and excites one or more bending modes of the diaphragm (not shown). This driving force when applied to the diaphragm using the voice coil produces radiated audio signals from the excited bending modes and the piston mode and these radiated signals include audio signal and a measurable audio signal distortion, referred to as a measurable distortion component. Each of the excited bending modes is centrally located at a frequency but the lowest resonant bending frequency is the vibrational frequency of the first bending mode, which is called a first-lowest frequency bending mode. A second bending mode has a different resonant frequency, and it is generally the second lowest frequency of the various vibrational frequencies of the bending modes. This frequency is in turn called a second-lowest frequency and it has a frequency that is lower than other succeeding bending modes but still higher than the resonant bending frequency of the first bending mode (i.e., the first-lowest frequency). In practice, the voice coil 218 is mounted at a location on a rear side of the diaphragm that is coincident with a nodal line location of the first-lowest frequency. When acted upon by the driving force, the bending modes of the audio signals radiate from the surface of the diaphragm with nodal line locations having no bending mode radiation with each bending mode having one or more specific nodal line locations. Driving a BMR transducer with a voice coil 218 mounted at a location that is coincident with a nodal line location of the first-lowest frequency is advantageous since a driving force applied at this location will tend to have a lower distortion component at the first-lowest frequency bending mode and thus a lower overall level of distortion on the radiated audio signals.

The voice coil 218, when mounted on the voice coil former 204, is placed within a gap defined between several components forming a magnetic circuit which include a pole piece 208, a back plate 210 and a front plate 212 in proximity to a magnet 214 in one embodiment. The relative location of these components can vary in alternative embodiments even though the functional operation of the transducer 200 remains similar. In the depicted embodiment, the magnet 214 is a ceramic ferrite magnet while in alternative embodiments, the magnet can be a rare earth magnet or an electromagnet. Regardless of the particular magnet used, a steady-state magnetic field is interposed upon the voice coil 218 wound upon the voice coil former 204. The interaction between the magnetic field in the gap and the electrical current flowing through the voice coil 218 gives rise to an electrodynamic force that causes the voice coil former 204 to drive the diaphragm 202 which in turn generates pistonic motion of the diaphragm and diaphragm bending modes that give rise to signals that radiate from the outer surface of the diaphragm 202 over desired acoustic and/or ultrasonic frequencies. In structure, the voice coil former 204 is a cylindrical element upon which the voice coil 218 is mounted or wound upon when placed within the gap.

The pole piece 208 is a centralized structure within the electromechanical transducer 200 and provides a structure defining a first side of an air gap into which the mounted voice coil 218 is placed. In a common arrangement the opposing side of the gap is defined by the front plate 212 and the magnet 214. The back plate 210 completes a magnetic circuit and sets the base of the gap upon which both the pole piece 208 and the magnet 214 are placed in an embodiment. In this illustrated embodiment, a magnetic circuit is formed by the arrangement of magnet 214, pole piece 208, air gap, front plate 212, back plate 210, and voice coil 218 that is positioned within the air gap such to orthogonally intersect the magnetic field present across the air gap.

Figure 3A:
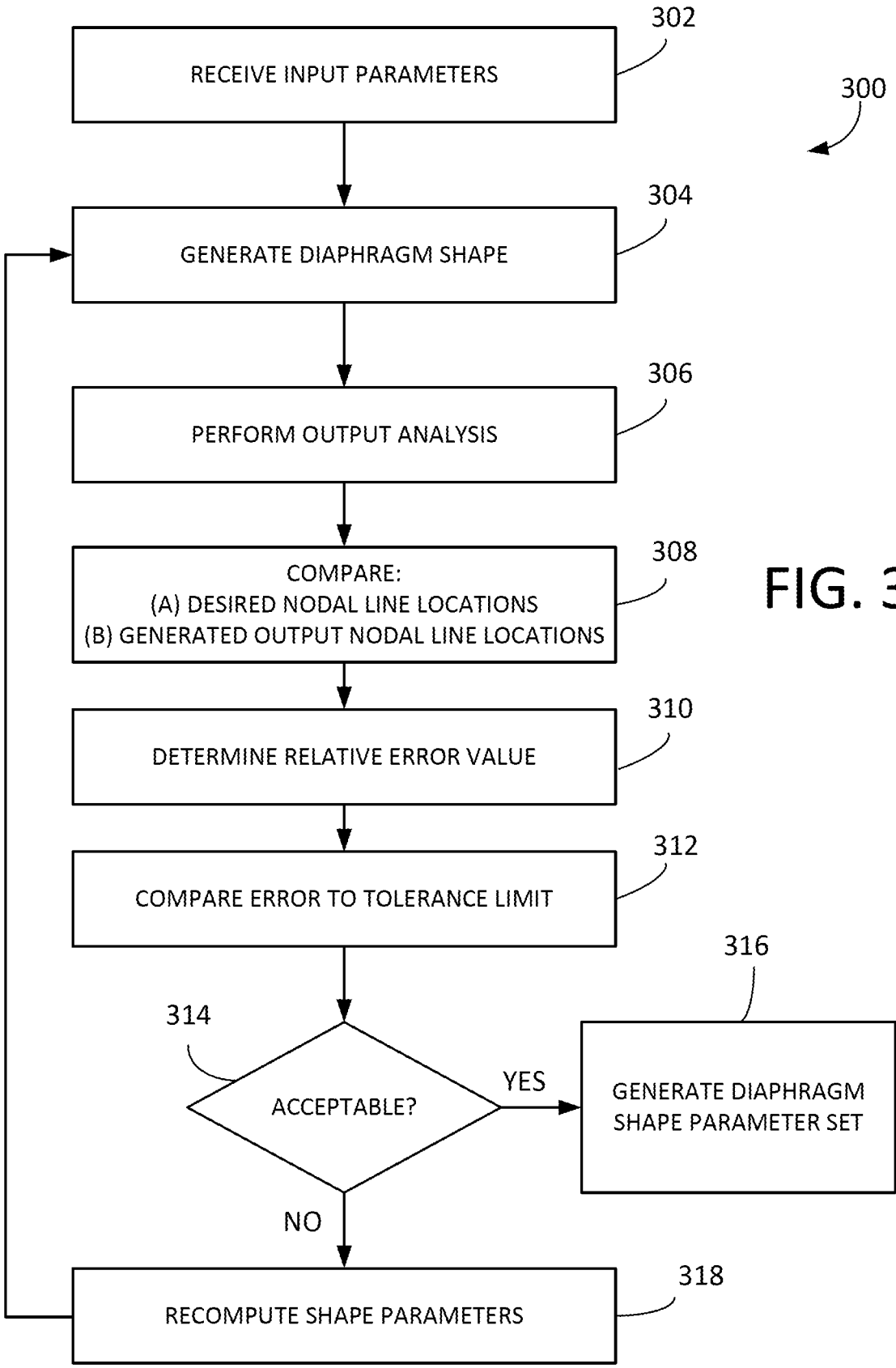
FIG. 3A is a flow chart illustrating a method of selecting parameters for a curved diaphragm for a balanced mode radiator in an embodiment.

FIG. 3A is a flow chart illustrating an embodiment of a process used in making a curved diaphragm BMR. The design and generation of a curved diaphragm BMR, as illustrated in the flow chart 300, entails receiving a plurality of input parameters, as shown at step 302, that define the general shape of a candidate curved diaphragm. The input parameters are used in a curvature function with initial conditions to define a diaphragm geometry. One of the input parameters used in establishing a curvature function is distance, and more specifically, the distance outward from the center of a diaphragm following the surface of the diaphragm (i.e., arc length). Other parameters used in establishing a curvature function must have some non-zero values to avoid forming a flat diaphragm geometry. Other initial parameters pertain to initial conditions for a diaphragm profile such as slope as the radius approaches zero near the center of the diaphragm (which is set to zero for a smooth and continuous surface on an axisymmetric diaphragm), Y-intercepts for a set of diaphragm curvature profiles, and a set of initial estimates for these values. Once generated, the curvature functions are used to generate a shape for a diaphragm, as shown at step 304, and this generated diaphragm shape is simulated and its output characteristics analyzed, as shown at step 306, to determine the general distribution of eigenfrequencies (natural resonant frequencies of the diaphragm) and eigenmodes (vibrational behavior of the diaphragm at the resonant frequencies). As used in the context of the present embodiments of the described methods, devices and systems, an eigenmode of a diaphragm is either one of the bending modes or the piston mode, all of which are vibrational modes of a diaphragm. In this context, each of these bending modes consist of zones of activity having amplitude, phase and an oscillation frequency. The spatial patterns generated by the oscillations from bending modes also have certain nodal lines or zones of zero translation, which are in practical terms locations of little to no activity of the diaphragm. From the output analysis performed at step 306 a comparison is made between the generated output nodal line distribution and the desirable output nodal line distribution, as shown at step 308. The output patterns from candidate diaphragms are compared to desired nodal line locations to assess output acoustic performance. The comparison of output eigenfrequency patterns entails not only a comparison of signal output patterns but also a systematic comparing of target nodal line locations to the generated output nodal line locations of the output pattern (as shown at step 308). In performing the comparative analyses, a relative error value between the desired nodal line locations and the nodal line locations for a candidate diaphragm is computed, as shown at step 310, and a comparison is made between the computed error and a predetermined tolerance limit, as shown at step 312. In one embodiment, the tolerance limit is established by measuring the width of the glue bond region formed by the bond between a voice coil former and a diaphragm. However, in alternative embodiments, particularly those involving the manipulation of multiple bending modes, a cost function will need to be used to determine the optimum curvature. In comparing the relative error value to the tolerance limit, the determined relative error value is further evaluated to check whether it is equal to or less than the tolerance limit. If the error is equal to or falls below the tolerance limit, the relative error value is deemed to be acceptable, as shown at step 314. The parameters defining the profile for the diaphragm are then compiled for generation of a diaphragm profile, as shown at step 316. Alternatively, if the relative error value exceeds the tolerance limit, as shown at step 314, a new set of candidate parameter values are generated and inserted into the iterative process shown in the flow chart until the relative error value falls within the tolerance limit.

More generally, a normalized approach can be employed to determine the degree of curvature required in a reference embodiment from which alternative embodiments of diaphragms can be determined. This reference embodiment can be used to determine a curvature function that shifts the nodal line of the first bending mode inwards by an amount to achieve an inertially balanced configuration where the voice coil velocity at the first mode is equal to or less than the voice coil velocity at the second mode. The following conditions and restrictions should be used when employing this method to determine such alternative embodiments. These conditions and restrictions for determining degree of curvature are representative and do not preclude the use of alternative or additional conditions and restrictions as may be known by those of ordinary skill in the art:

The plan view of the diaphragm is circular in shape.

An isotropic material is used for the diaphragm.

Diaphragm thickness is constant.

The magnitude of the curvature increases with increasing radius.

The curvature is zero at the center of the diaphragm.

While this reference embodiment was created using linear curvature functions, other functions provide similar results so long as the conditions above are satisfied. Higher order curvature functions and constant curvature functions do not shift the position of the nodal lines as significantly as linear curvature functions. Constant curvature was the least effective at shifting the first bending mode's nodal line from among the functions tested since a slightly higher edge height is required to achieve a similar first bending mode's nodal line location. The reference embodiment is described in dimensionless terms to provide a general illustration of the movement of the location of the first nodal line of the diaphragm. This is accomplished by dividing or "scaling" each relevant distance by the diaphragm radius. Relative diaphragm thickness (T) is one of the control parameters and is comprised of diaphragm thickness as a percentage of the radius. The other control parameter is the relative edge height (H) at the periphery of the diaphragm, as measured from the minimum point on the same surface and scaled as a percentage of the diaphragm radius. This parameter can be attained with any number of curvature profiles that follow the stated restrictions.

Figure 3B:
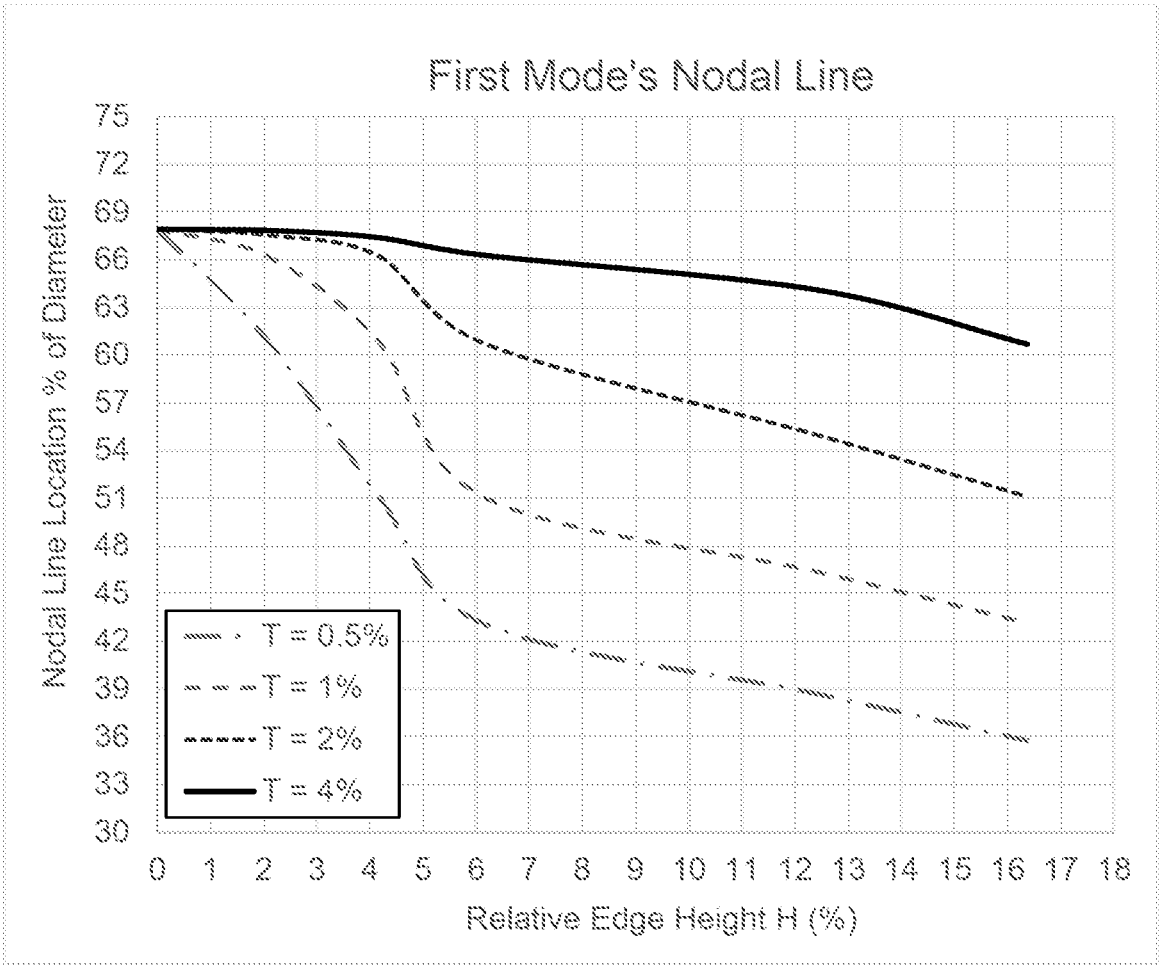
FIG. 3B is a graph illustrating nodal line position based on relative edge height and diaphragm thickness for a balanced mode radiator in an embodiment.

FIG. 3B illustrates the nodal line position of the first eigenmode as a function of relative edge height and diaphragm thickness for linear curvature diaphragm profiles. Linear functions are used in this figure since they provide the most accurate comparison and, in the data presented below, nodal line manipulation is performed in 5% increments. The table below provides a fast approximation of the relative edge height (H). The values shown in this table provide relative edge heights (H) of a diaphragm for a given nodal line location and relative diaphragm thickness (T).

| Relative Edge Height (%) | | | | | | |
|---|---|---|---|---|---|---|
| | Nodal Line Location | | | | | |
| T | 65% | 60% | 55% | 50% | 45% | 40% |
| 0.50% | 0.91 | 2.29 | 3.35 | 4.39 | 5.26 | 10.22 |
| 1% | 2.71 | 4.35 | 5.01 | 6.97 | 14.13 | >16.5 |
| 2% | 4.6 | 6.78 | 12.39 | >16.5 | >16.5 | >16.5 |
| 4% | 10.25 | >16.5 | >16.5 | >16.5 | >16.5 | >16.5 |

Figure 3C:
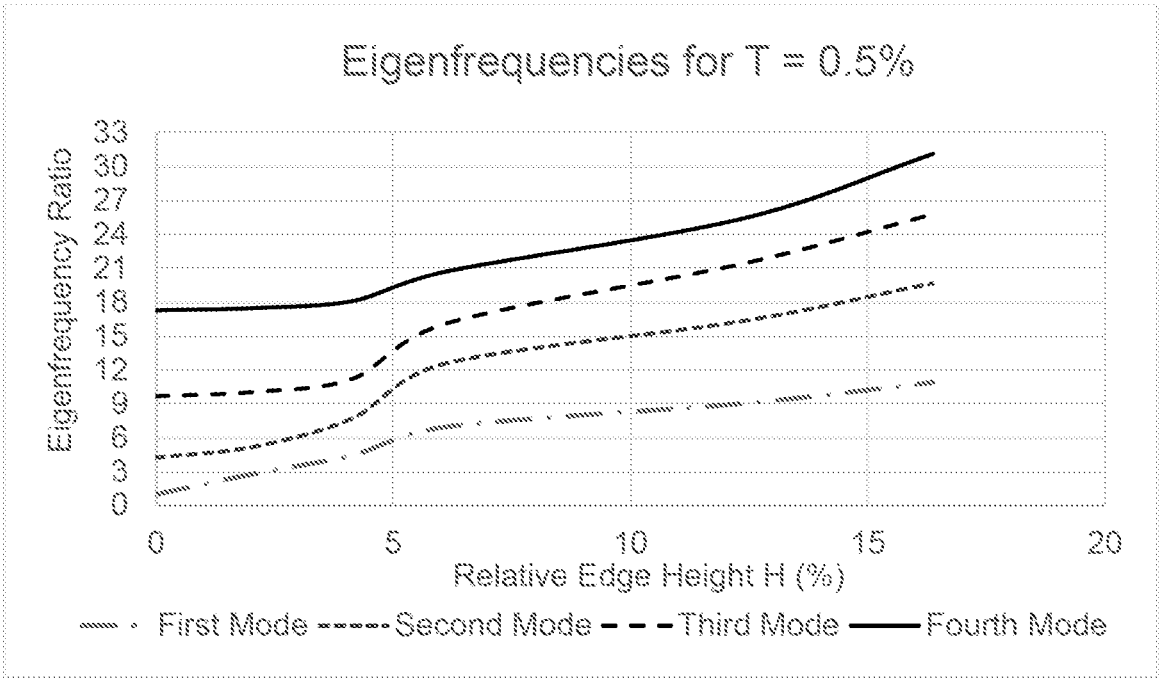
FIG. 3C is a graph illustrating changes in eigenfrequency ratio versus relative edge height of a balanced mode radiator in an embodiment.
Figure 3D:
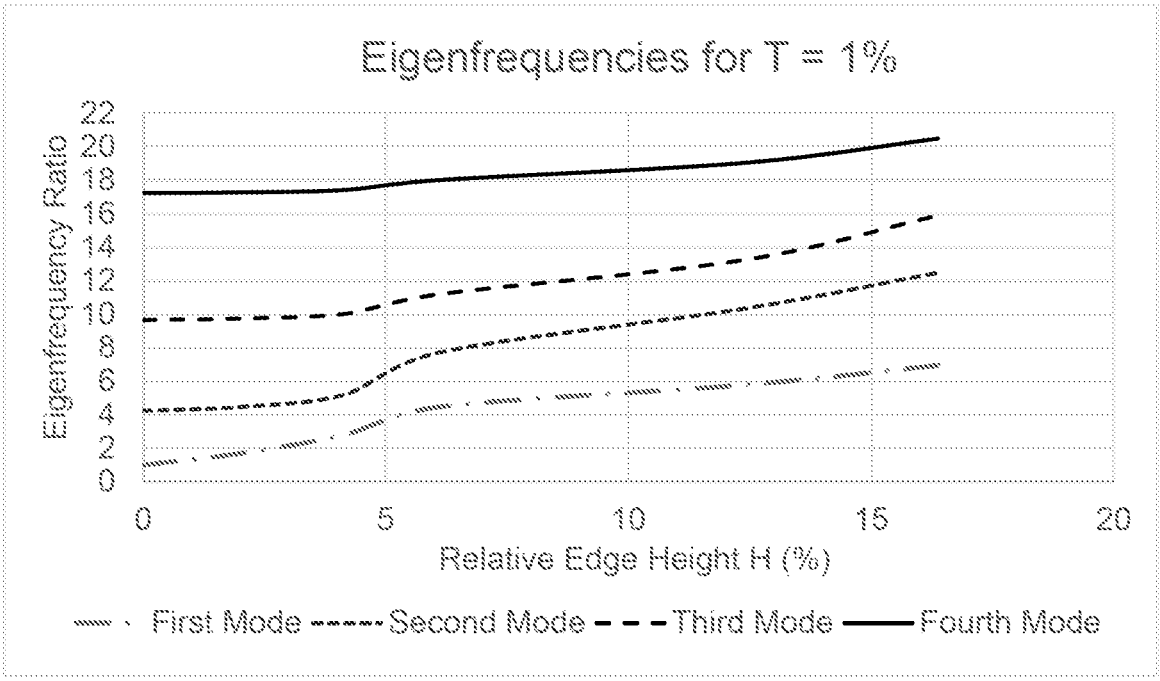
FIG. 3D is a graph illustrating changes in eigenfrequency ratio versus relative edge height of a balanced mode radiator in an embodiment.
Figure 3E:
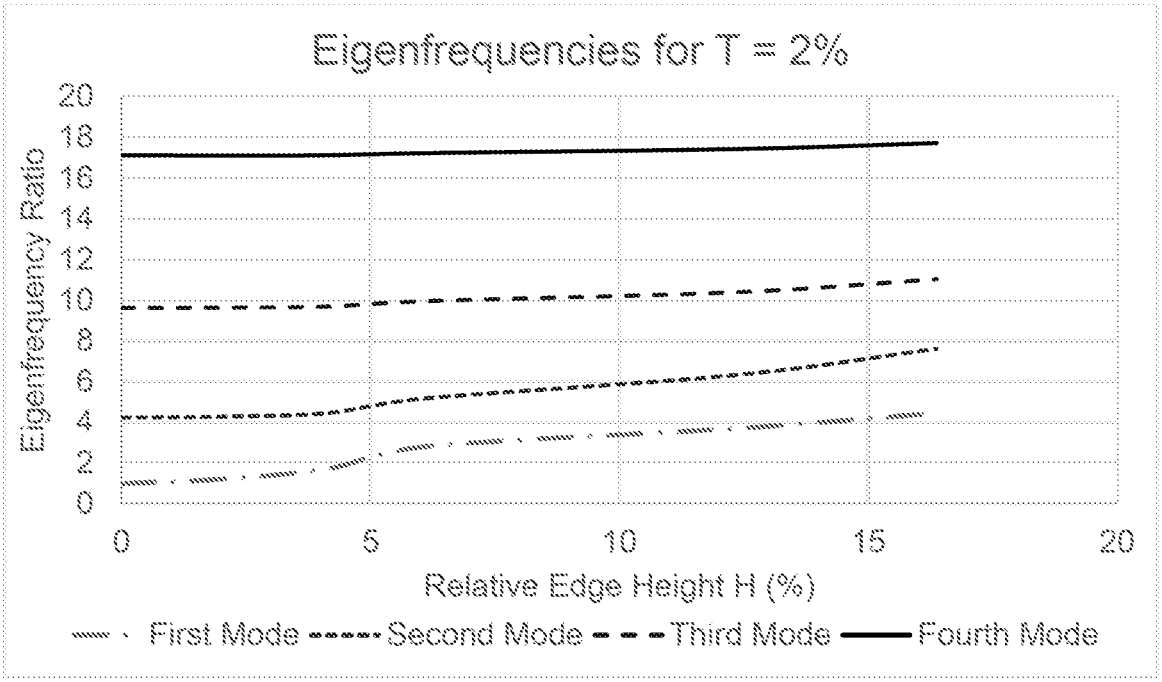
FIG. 3E is a graph illustrating changes in eigenfrequency ratio versus relative edge height of a balanced mode radiator in an embodiment.
Figure 3F:
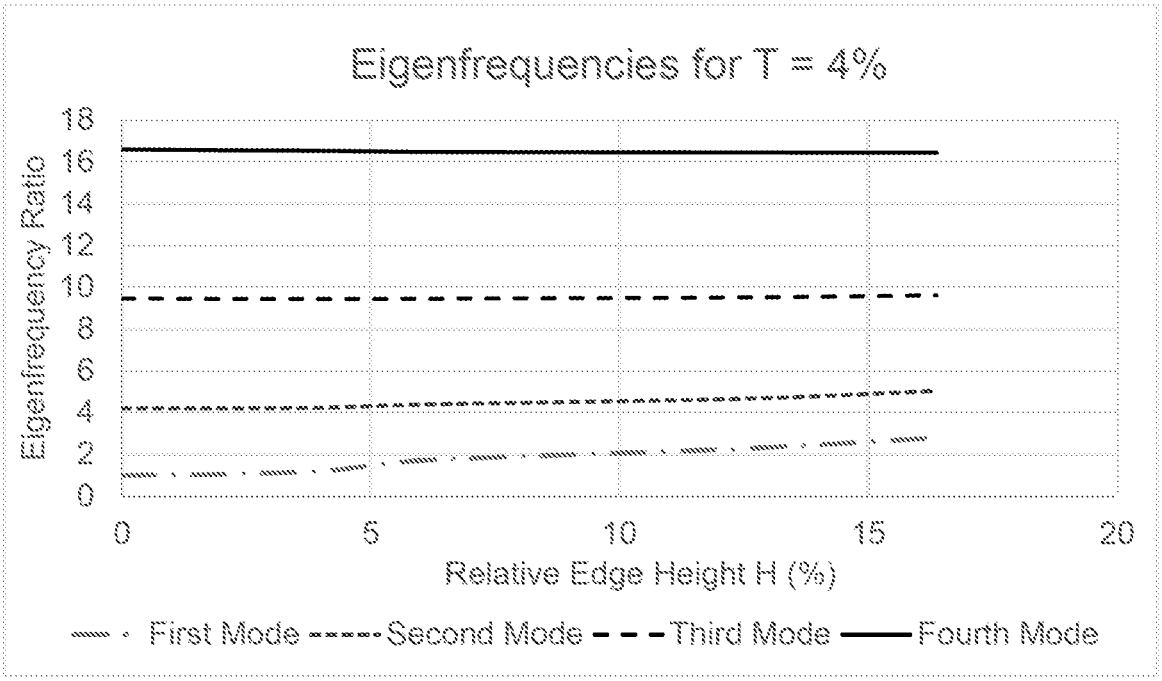
FIG. 3F is a graph illustrating changes in eigenfrequency ratio versus relative edge height of a balanced mode radiator in an embodiment.

With increased relative diaphragm edge height, the eigenfrequencies are also increased which tends to have a greater and more pronounced effect on thinner diaphragms (i.e., diaphragms with a relative thickness of 2% or less). For a given diaphragm geometry, dividing each of the eigenfrequencies by the eigenfrequency of the first mode for a flat disk with the same thickness, a normalized trend is revealed which can be used to further manipulate the modal behavior. By controlling the eigenfrequencies of diaphragms in this manner, significant performance advantages can be achieved. In particular, the grouping of modes can be increased within a certain bandwidth to provide additional acoustic radiation or a lighter diaphragm can be used because the first mode is moved significantly higher in frequency for diaphragms of low relative thickness. The combination of relative diaphragm thickness, curvature profile, and diaphragm material control the eigenfrequencies of the diaphragm. In some embodiments, a diaphragm is made from monolithic material such as aluminum with thicknesses in the range of 0.15 mm to 0.3 mm and paper with thicknesses in the range of 0.2 mm to 0.5 mm. Other alternatives for material composition include composite materials (e.g., skin, honeycomb core, skin) of typical thicknesses in the range of 1 mm to 5 mm, or foamed material (e.g., Rohacell) with thicknesses in the range of 0.5 mm to 5 mm. Generally, one of the more important design considerations is stiffness to weight ratio and the ability to manufacture diaphragms with low thicknesses (i.e., thin materials) since the effect of curvature is more pronounced with thinner materials. FIGS. 3C, 3D, 3E and 3F show the effects on eigenfrequency ratio (defined as the ratio of a given eigenfrequency to the eigenfrequency of the first bending mode in a flat diaphragm) as a function of relative diaphragm edge height to further illustrate the effects of this method. FIG. 3C illustrates the change in the first four bending mode eigenfrequencies as a function of relative edge height (H) for diaphragms with a 0.5% relative diaphragm thickness and linearly changing diaphragm curvature profiles. FIG. 3D illustrates the change in the first four bending mode eigenfrequencies as a function of relative edge height for diaphragms with a 1% relative diaphragm thickness and linearly changing diaphragm curvature profiles. FIG. 3E illustrates the first four bending mode eigenfrequencies as a function of relative edge height for diaphragms with a 2% relative diaphragm thickness and linearly changing diaphragm curvature profiles. FIG. 3F illustrates the first four bending mode eigenfrequencies as a function of relative edge height for diaphragms with a 4% relative diaphragm thickness and linearly changing diaphragm curvature profiles.

Figure 3G:
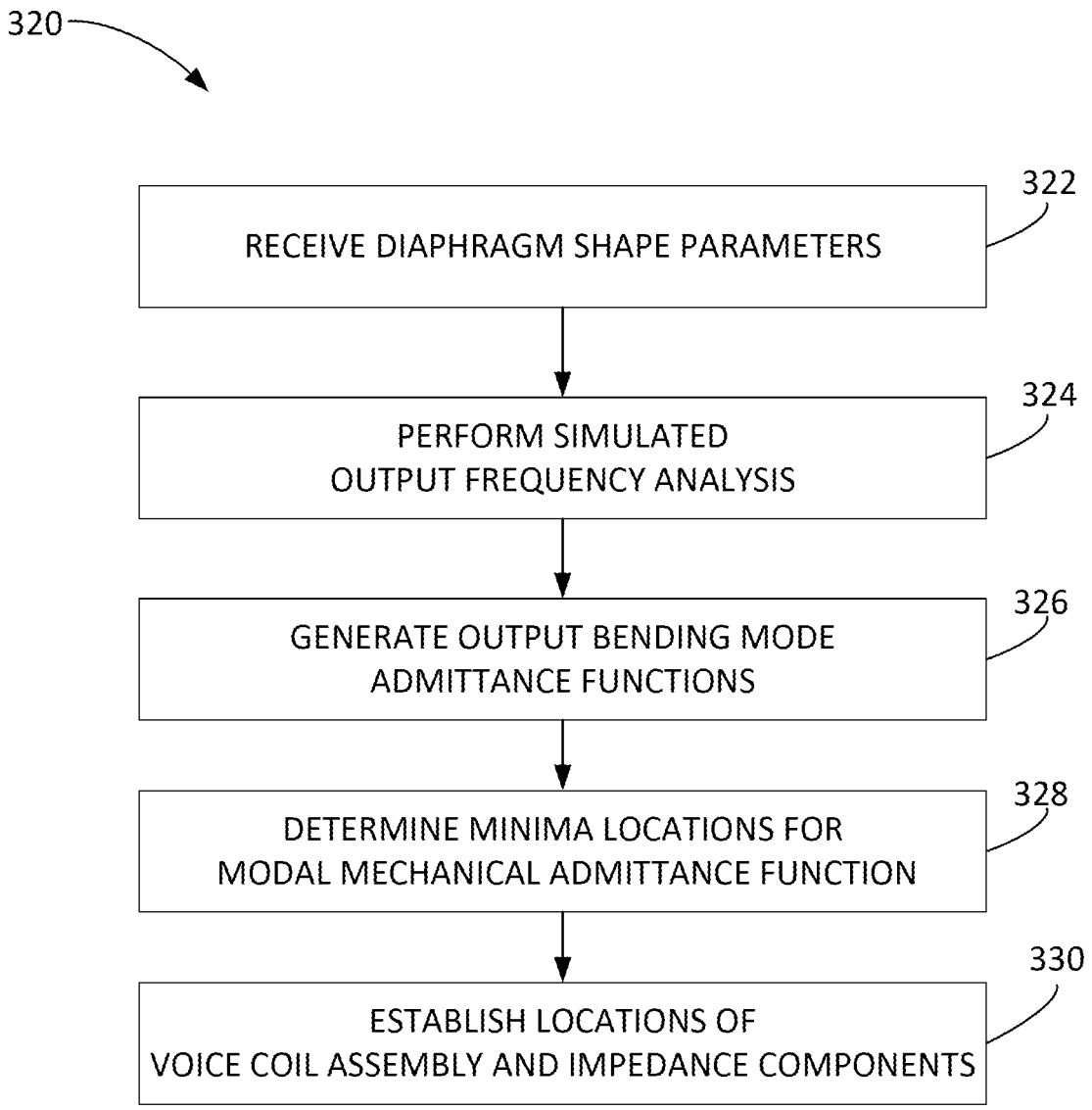
FIG. 3G is a flow chart illustrating a method of balancing a curved diaphragm for a balanced mode radiator in an embodiment.

FIG. 3G is a flow chart illustrating an embodiment of a process for inertially balancing a curved diaphragm to form a BMR. The method 320 commences with the receiving of shape parameters for defining the geometry of a diaphragm to be simulated and created, as shown at step 322, produced from the process for making a diaphragm 300. Once the shape parameters have been received, an eigenfrequency output analysis is performed, as shown at step 324, that simulates reproductions of the eigenmodes of the diaphragm. The simulated rendering of output eigenmode bending behavior is performed for N eigenfrequencies up to the highest eigenfrequency within the target bandwidth of the diaphragm. Typically, this is the third or fourth bending mode eigenfrequency. Once the simulated output frequency analysis is performed, as shown at step 324, mechanical admittance functions for the highest bending mode and all lower frequency bending modes are generated, shown as step 326.

Identification of the eigenmode shapes is a means of determining, simulating and analyzing mechanical admittance functions for bending modes, as shown at step 328. The mechanical admittance function for a given bending mode quantifies at a range of positions on the diaphragm, how readily vibrational forces from an external source such as a voice coil assembly can be transferred into the bending velocity of the diaphragm for that given mode. The minima of a given mechanical admittance function are the nodal lines for a given mode. These are the regions where, if input force is applied, there is an inefficient transfer of energy into the bending behavior of the diaphragm for each corresponding mode when driving the diaphragm at these regions. The peaks of the mechanical admittance function identify antinodes or locations where energy can be readily converted into bending behavior of the diaphragm and an applied force results in a high bending velocity. The center of the diaphragm and edge of the diaphragm are antinodes for every bending mode. A mechanical admittance function is generated for each bending mode.

In designing optimal curved diaphragms, a working assumption is that there are N applicable bending modes within the desired bandwidth for a shape geometry. Once the set of mechanical admittance functions are generated containing different functions for each of N bending modes, the functions are combined in a weighted sum generating a modal mechanical admittance function. Collectively those computed minima locations from the modal mechanical admittance function, as shown at step 328, are used to determine the physical locations for the mounting of a voice coil assembly and one or more mechanical impedance components to balance a generated geometry for a BMR diaphragm, as shown at step 330. Distortion associated with the first mode is reduced by placing the voice coil assembly on a modal mechanical admittance minimum that is closest to the nodal line of the first mode. The locations of one or more balancing impedance components are set at the other N−1 minima locations where such locations are determined from an Nth-order analysis of mechanical admittance functions for each of the bending modes of a diaphragm geometry. Collectively, the Nth-order mechanical admittance functions of the bending modes form a modal mechanical admittance function. The result of adding the mechanical impedance components is to bring the bending behavior into an inertially balanced state where the Z-direction component of the summed surface velocities tends to the values of the pistonic mode. In addition, for a flat diaphragm, inertially balancing the behavior of the highest frequency mode also simultaneously corrects the lower modes. In this condition the diaphragm is inertially balanced over the frequency range covered by the chosen N modes. For a curved diaphragm BMR, a similar method may be adopted, but the lower modes intentionally behave differently than those for the flat panel. A modified method must be used to inertially balance the lower modes. In order to inertially balance a curved diaphragm for a BMR, modal mechanical admittance and relative mean modal velocity must be determined for the curved panel.

The determination of inertial balancing for a diaphragm is dependent upon the modal mechanical admittance function for the diaphragm. Generally, when modelling a flat diaphragm, a mechanical admittance function for any single mode is derived analytically. However, for non-flat structures, the analytical solution is more difficult to determine and may be impossible to derive. One practical way of determining the modal mechanical admittance function is to identify the highest eigenfrequency used. This highest eigenfrequency may be used to conduct frequency domain simulation where a ring force is applied at incremental radii starting from the center and ending at the edge of an axisymmetric diaphragm. The mean velocity magnitude should then be calculated for each of the driven radii and then assigned to that location. The total mechanical admittance is obtained by dividing this mean velocity magnitude by the total input force at each radial location, including the mechanical admittance component from the pistonic motion. For use with inertial balancing, only the bending modes should be considered, so the pistonic component of the total mechanical admittance function is to be subtracted to identify the modal mechanical admittance.

The diaphragm can be simulated in the frequency domain at the highest eigenfrequency using finite element analysis, constraining the diaphragm such that no bending occurs over the operative bandwidth, and using the same input force as used in the bending analysis. The mechanical admittance of the pistonic mode can then be subtracted from the total mechanical admittance function to identify a modal mechanical admittance. In the table below, the Mode column represents the eigenmode number, the Shape Function column represents the diaphragm velocity as a function of radial position from an eigenfrequency analysis, the Excitation Shape column is the output from a frequency domain analysis and is proportional to the total mechanical admittance, and the Modal Admittance column represents the modal mechanical admittance of the eigenmode. In the table, the constants "$C_n$" change for each row. "Psi" represents the normalized shape of each eigenmode, and "F" represents the input force.

| Mode | Shape Function | Excitation Shape | Modal Admittance |
|---|---|---|---|
| 0 | $\Psi_0$ | $F * C_0\Psi_0$ | 0 |
| 1 | $\Psi_1$ | $F(C_1\Psi_1 + C_0\Psi_0)$ | $C_1\Psi_1$ |
| 2 | $\Psi_2$ | $F(C_2\Psi_2 + C_1\Psi_1 + C_0\Psi_0)$ | $C_2\Psi_2 + C_1\Psi_1$ |
| n | $\Psi_n$ | $F\ \Sigma_{i=0}^{n} C_n\Psi_n$ | $\Sigma_{i=1}^{n} C_n\Psi_n$ |

Figure 4A:
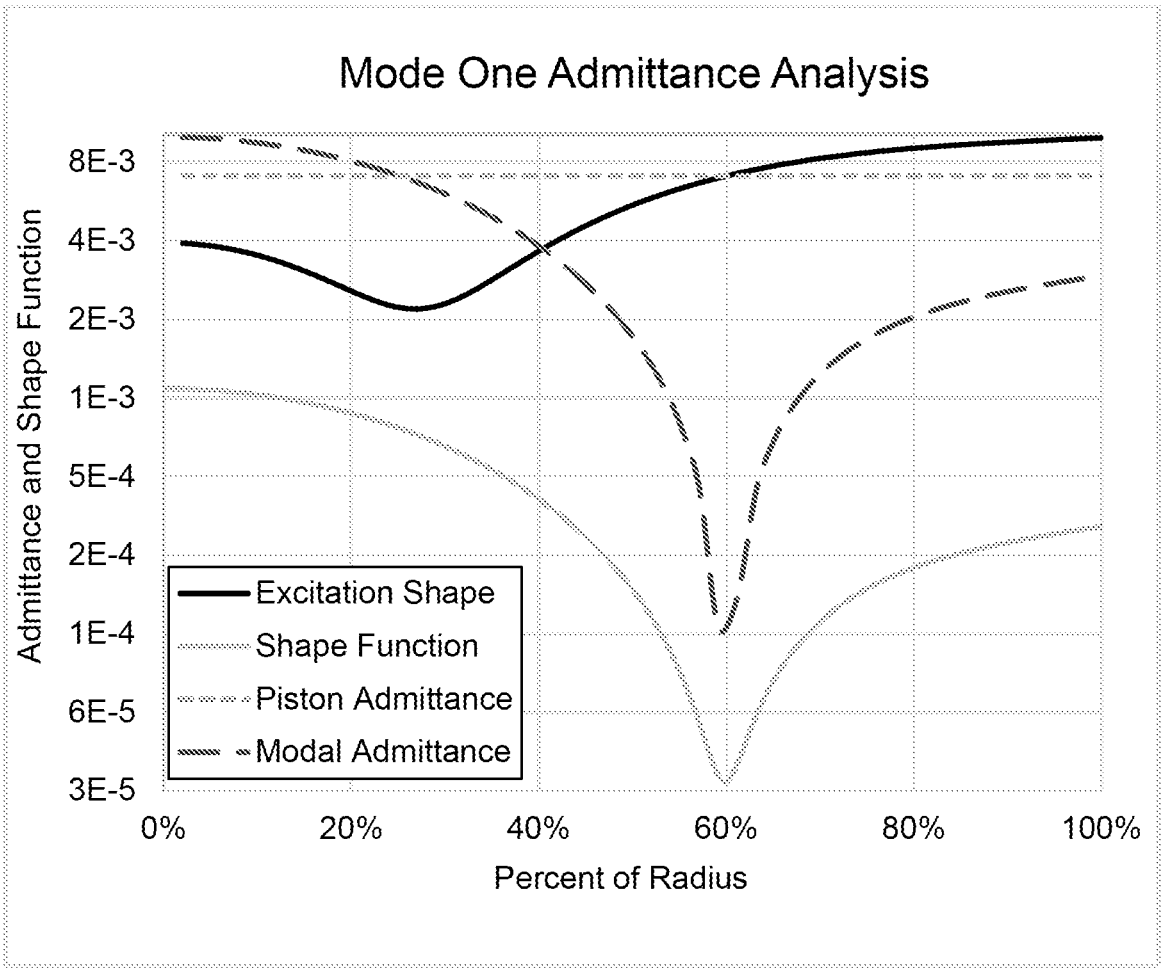
FIG. 4A is a graph illustrating the mechanical admittance and shape function for the first bending mode of a curved diaphragm balanced mode radiator in an embodiment.
Figure 4B:
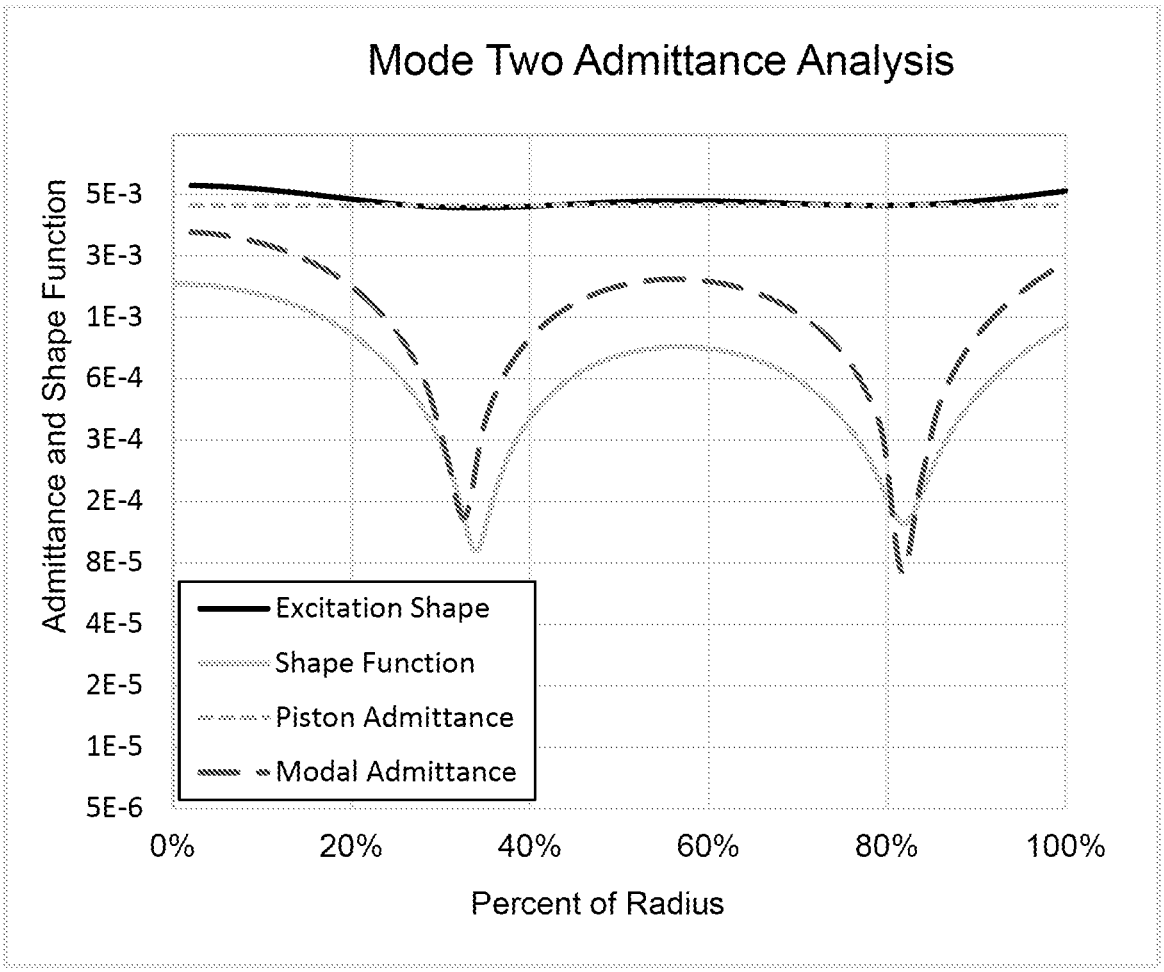
FIG. 4B is a graph illustrating the mechanical admittance and shape function for the second bending mode of a curved diaphragm balanced mode radiator in an embodiment.
Figure 4C:
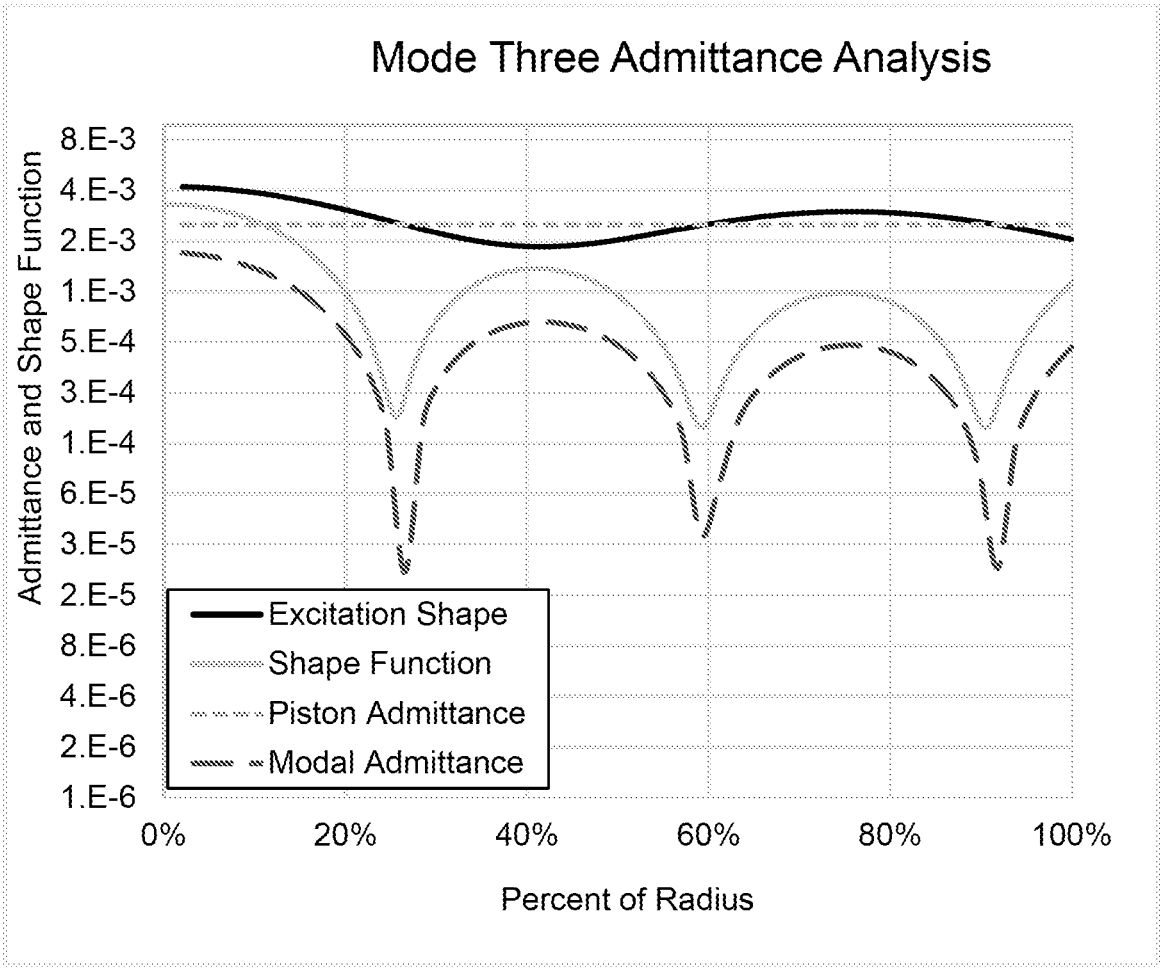
FIG. 4C is a graph illustrating the mechanical admittance and shape function for the third bending mode of a curved diaphragm balanced mode radiator in an embodiment.
Figure 4D:
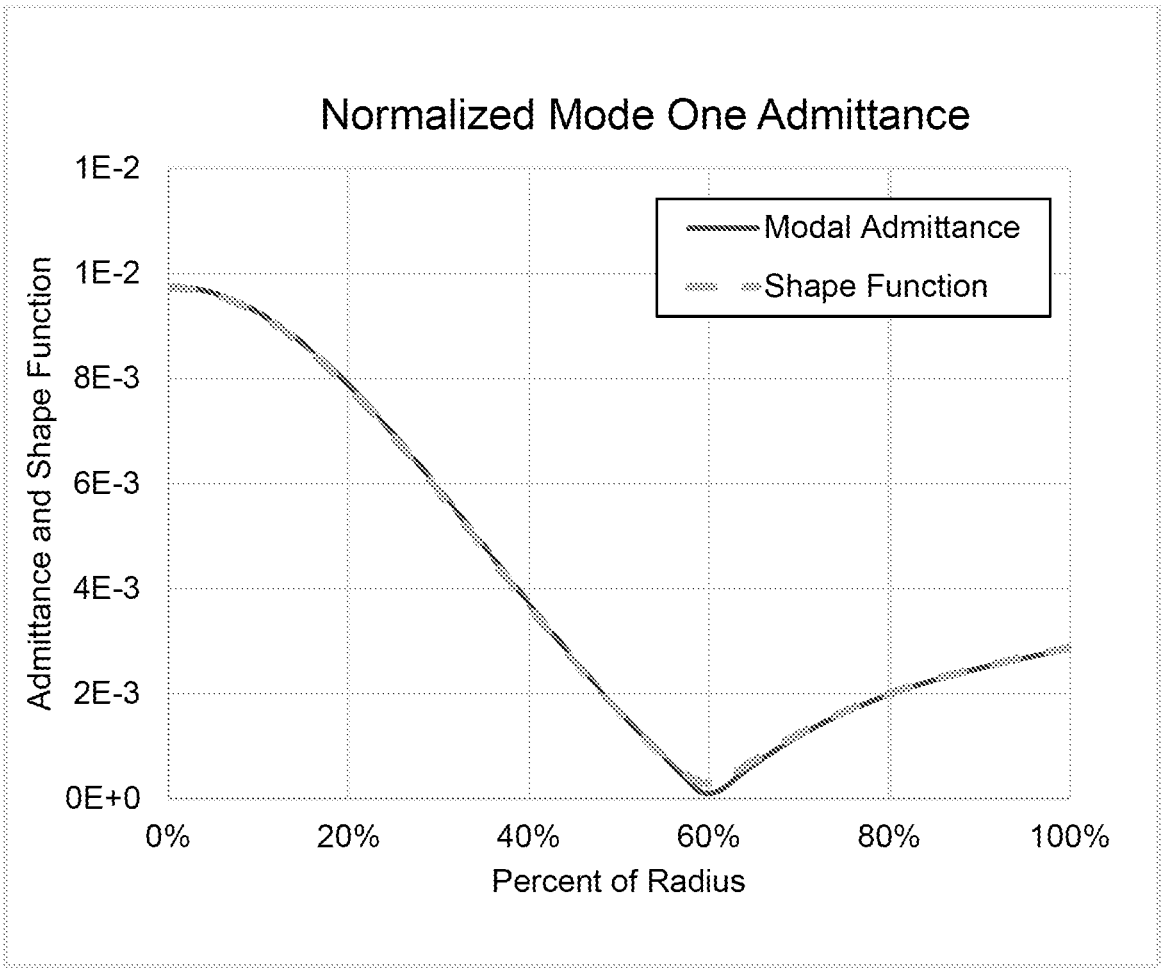
FIG. 4D is a graph illustrating a comparison between modal mechanical admittance and the mode shape function for the first mode of a curved diaphragm balanced mode radiator in an embodiment.
Figure 4E:
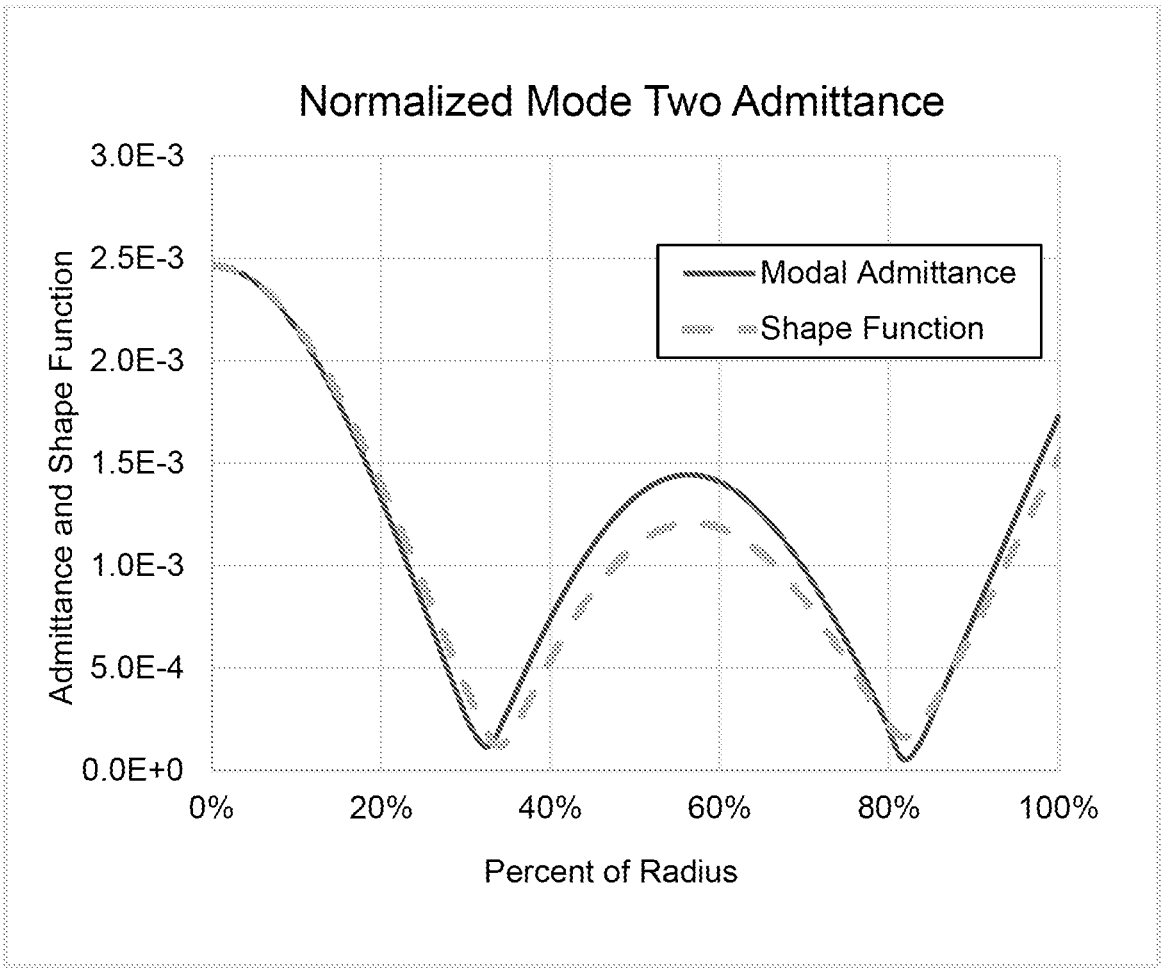
FIG. 4E is a graph illustrating a comparison between modal mechanical admittance and the mode shape function for the second mode of a curved diaphragm balanced mode radiator in an embodiment.

FIGS. 4A, 4B and 4C are graphs illustrating modal mechanical admittance and shape function at the frequencies of the first, second and third bending modes, respectively, of a curved diaphragm balanced mode radiator in an embodiment relative to their locations measured as a percentage of diaphragm radius. In FIG. 4A, the diaphragm uses a linear curvature profile, has a 2% relative diaphragm thickness (T), and the nodal line of the first bending mode has been manipulated inwards by 9% from a 69% of radius to 60% of radius. For the first bending mode as shown in FIG. 4A, the shape function is nearly identical in shape to the modal mechanical admittance. This property is repeatedly illustrated in comparisons of modal mechanical admittance and shape function for the second bending mode, as seen in FIG. 4B, and for the third bending mode, as seen in FIG. 4C. When normalized, the modal mechanical admittance and shape functions for the first bending mode are matched at the center of a diaphragm and a direct comparison is possible, as shown in FIG. 4D, since the motion of the diaphragm is dictated primarily by pistonic motion and the bending motion of the first bending mode. At a higher bending mode, the diaphragm motion is comprised of the motion of that bending mode, the motion of all the lower bending modes, and the motion of the pistonic mode. When comparing between the modal mechanical admittance of the second bending mode and the shape function for that bending mode, a complete match is not observed, as shown in FIG. 4E. Because the modal mechanical admittance for each mode is comprised of the mechanical admittance for all the lower modes, the modal admittance minima are shifted slightly from the shape function minima. The resulting minima locations from the modal mechanical admittance function are ideal for placement of inertial balancing masses.

The degree to which a diaphragm is inertially balanced can be determined by evaluating how closely the mean of the bending velocity tends to the pistonic velocity at any frequency within the operational bandwidth. This evaluation is determined by measuring the magnitude and phase of the surface velocity on the vibrating surface of the diaphragm. Both the mean and root-mean-squared ("RMS") volume velocities over the vibrating surface of the diaphragm can be evaluated at a high frequency resolution (typically 24 points per octave as a minimum resolution) within the operational bandwidth to accurately quantify the degree of inertial balancing for a diaphragm. Analytically, the mean volume velocity can be evaluated with the integral expression below:

$$\Psi_{mean} = \frac{1}{S}\int_0^S \Psi dS$$

The RMS velocity can be evaluated using the following expression:

$$\Psi_{rms} = \sqrt{\frac{1}{S}\int_0^S \Psi^2 dS}$$

where Psi (ψ) represents the surface velocity on the diaphragm, and S represents the area of the region of evaluation.

The final required expression pertains to the volume velocity of the pistonic component which can be determined using the following approaches. In a first approach, if a digitized FEA simulation, which contains coupled mechanical, acoustic and electromagnetic physics, is used to model the entire BMR, then the diaphragm may be constrained within the simulation to prevent bending while maintaining all other electro-mechanical properties of the BMR. In a second approach, the lower frequency pistonic behavior is matched to a lumped element simulation model of the BMR to estimate the pistonic velocity at high frequencies. This estimate of the high frequency pistonic velocity can be combined with the lower frequency pistonic velocity to determine the pistonic velocity over the entire operative bandwidth of the BMR. In both simulation and measurement, a current drive source is used to suppress electromotive-force effects and to suppress the effect of mechanical impedance rise at high frequencies for improved correlation between measurements and simulations.

The analytical expression below is used to determine a metric for how much the mean velocity in the Z-direction differs from the pistonic velocity which equates to the relative mean modal velocity:

$$\Psi_{rel} = \frac{\Psi_{mean} - \Psi_{piston}}{\Psi_{rms}}$$

The following expressions analytically define "Mean Volume Velocity" and "RMS Volume Velocity." These expressions are defined in terms of operators on discrete sets of data from observations in practical implementations. In these expressions, A is defined as the area of evaluation, AA is the incremental area, N is the total number of elements, and n is the element number in the summation.

$$\Psi_{mean} = \frac{1}{A}\sum_{n=1}^{N} \Psi_n \Delta A_n$$

-continued $$\Psi_{rms} = \sqrt{\frac{1}{A}\sum_{n=1}^{N} \Psi_n^2 \Delta A_n}$$

Generally, in a balanced diaphragm, the relative mean modal velocity should be below 25%, but in a well-balanced diaphragm it should be less than 18%. The determination of these values can be performed using a scanning laser vibrometer to evaluate an audio device, and finite element analysis to assess a simulated audio device. Spatially discrete versions of the above formulas can be used if measurement locations are distributed to provide a minimum of five locations per bending wavelength at the highest frequency in the operative bandwidth to ensure sufficient spatial resolution.

Figure 5A:
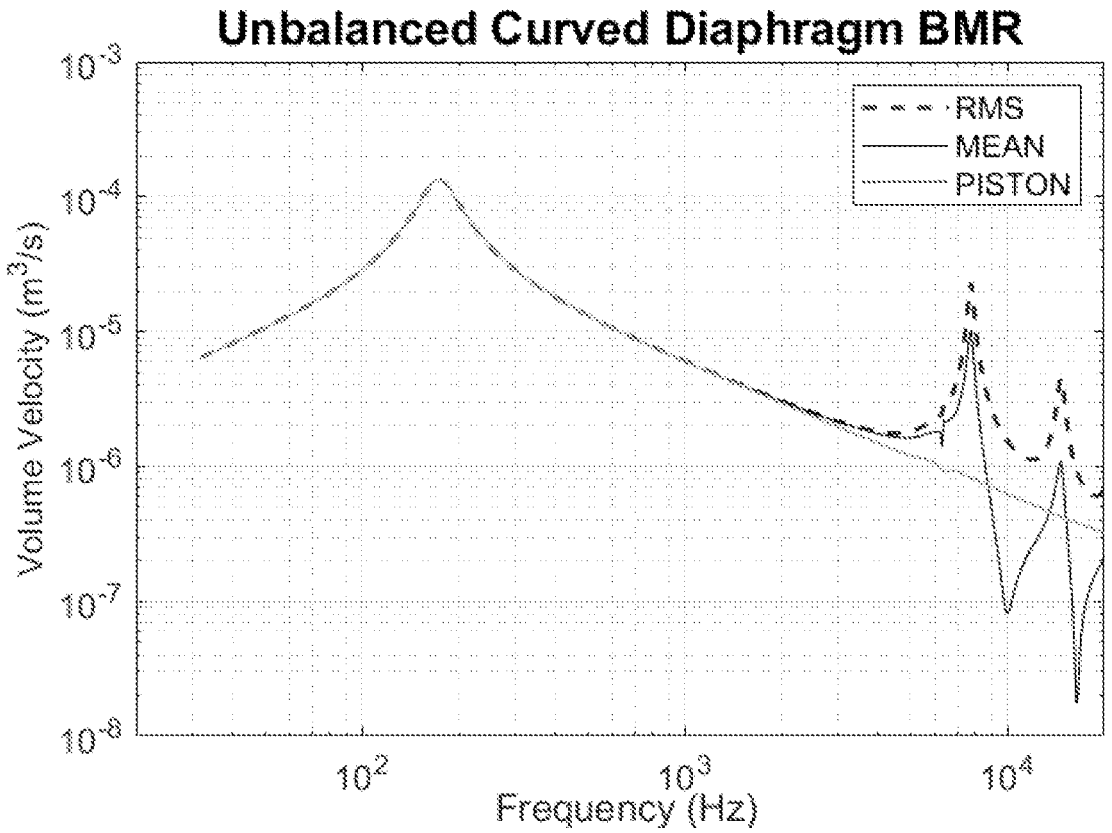
FIG. 5A is a graph illustrating a simulated volume velocity of an unbalanced curved diaphragm for a balanced mode radiator in an embodiment.
Figure 5B:
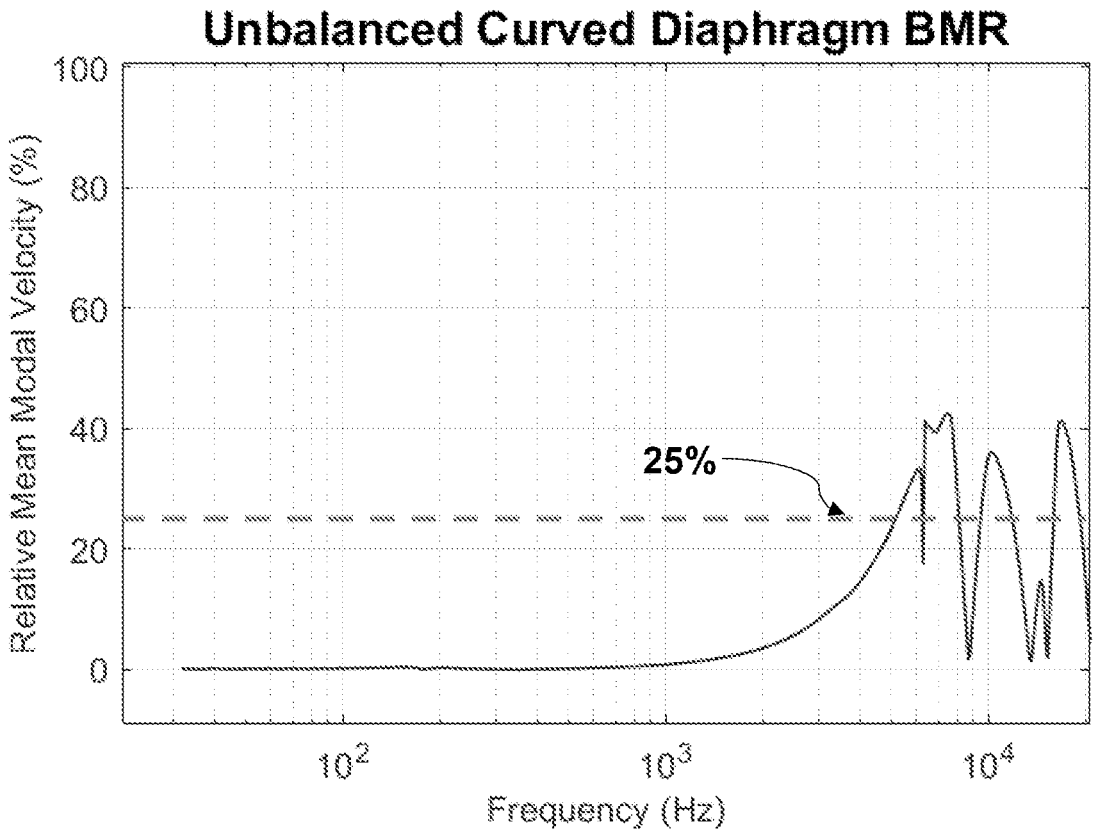
FIG. 5B is a graph illustrating the relative mean modal velocity of an unbalanced curved diaphragm for a balanced mode radiator in an embodiment.
Figure 5C:
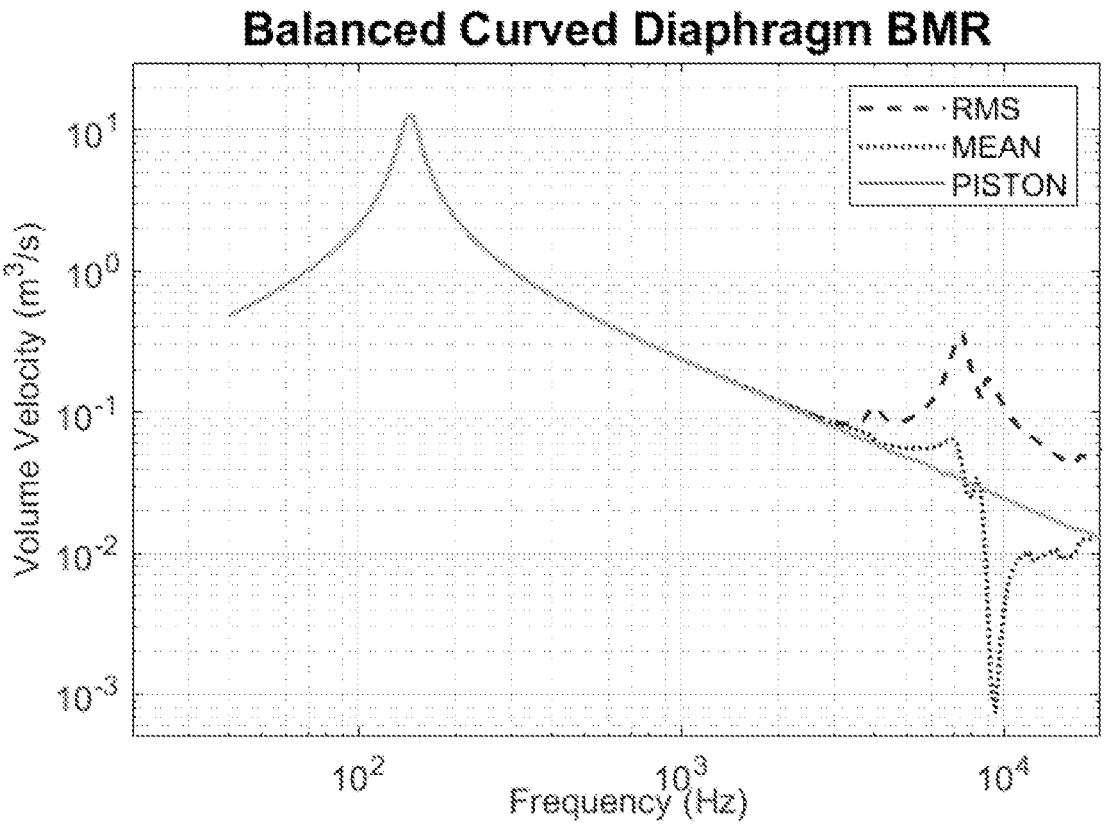
FIG. 5C is a graph illustrating a simulated volume velocity of a balanced curved diaphragm for a balanced mode radiator in an embodiment.
Figure 5D:
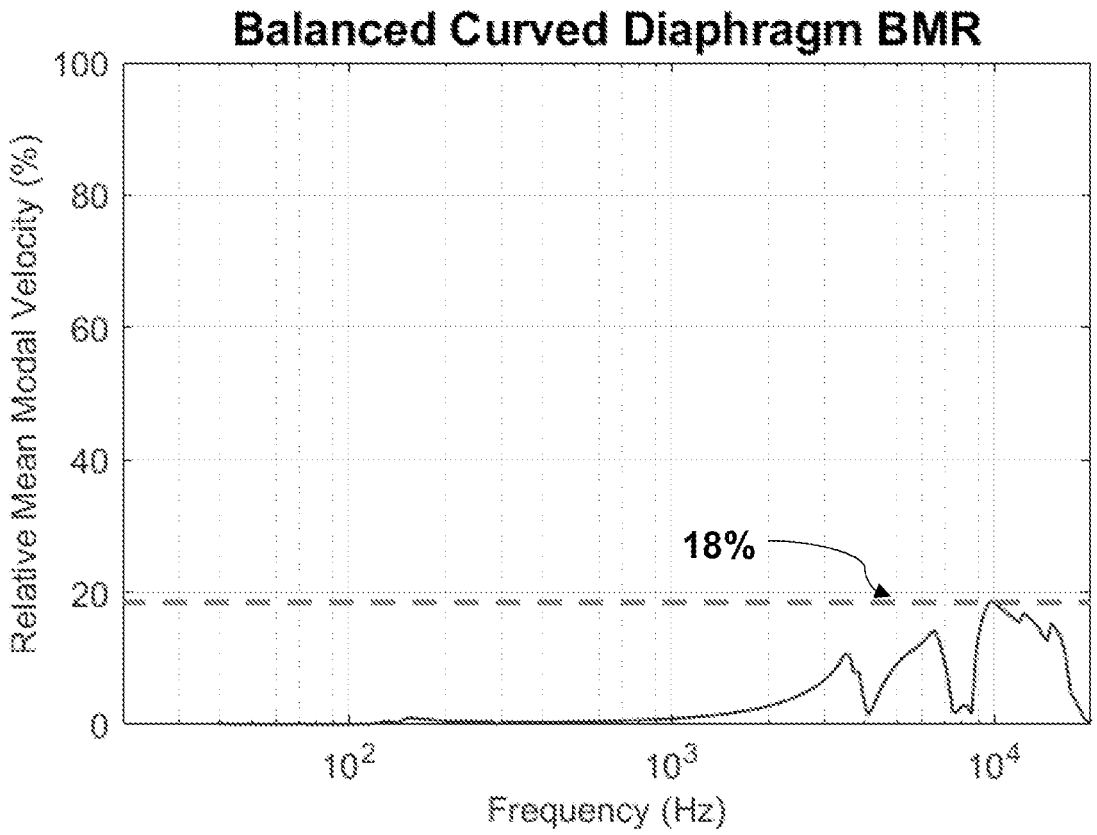
FIG. 5D is a graph illustrating the relative mean modal velocity of a balanced curved diaphragm for a balanced mode radiator in an embodiment.

Generally, the performance of a full transducer can be simulated with and without inertial balancing components. In a simulated embodiment of a 40 mm diameter aluminum diaphragm, various relative mean modal velocities were determined before and after balancing as illustrated in FIGS. 5A, 5B, 5C and 5D. Below a frequency of 20 kHz (i.e., the operative frequency range of most useful audio applications), an inertially balanced diaphragm has a relative mean modal velocity less than 18% indicating that it is well balanced. FIG. 5A illustrates the RMS, mean and pistonic components of volume velocity using a finite element analysis ("FEA") model for simulating volume velocity of an unbalanced 40 mm diameter curved aluminum diaphragm in an embodiment. FIG. 5B illustrates FEA simulation results for the relative mean modal velocity for an unbalanced 40 mm diameter curved aluminum diaphragm in an embodiment. The 25% criterion for an inertially balanced diaphragm is indicated by a horizontal line which is exceeded in this unbalanced example. In contrast, FIG. 5C illustrates FEA simulation results of the RMS, mean and pistonic components of volume velocity of a balanced 40 mm diameter curved aluminum diaphragm in an embodiment. FIG. 5D illustrates FEA simulation results for the relative mean modal velocity of a balanced, 40 mm diameter curved aluminum diaphragm in an embodiment. The 18% criterion for an inertially well-balanced diaphragm is indicated by a horizontal line which is not exceeded in this inertially balanced example.

Generally, a diaphragm becomes substantially "inertially unbalanced" with the addition of a voice coil assembly. An inertially unbalanced diaphragm will have a relative mean modal velocity greater than 25% across the operating band. To inertially balance the diaphragm and reduce the relative mean modal velocity below 25% and preferably at or below 18%, one or more mechanical impedance components must be added. The number of added components typically corresponds to the number of minima of the modal mechanical admittance function of the highest in-band eigenmode. In some embodiments, one or more inner balancing masses can be combined into a single balancing disk.

In the case of a flat disk, the masses of each mechanical impedance component are proportional to the mass of the required voice coil assembly and the radial location where they placed on the diaphragm. However, the mass of the mechanical impedance component placed on the periphery of the diaphragm may be reduced in mass by up to 25% for ideal balancing. The mass proportions and locations for the flat BMRs are shown in the table below and they are proportionally scaled based on the mass of the voice coil assembly, which is located at one of the positions.

| Number of Modes Considered | Location and Mass Ratio (−20% to 25% for outermost location) | | | | |
|---|---|---|---|---|---|
| 1 | 0.68 | | | | |
| 2 | 0.39 | 0.84 | | | |
| 3 | 0.26 | 0.59 | 0.89 | | |
| 4 | 0.20 | 0.44 | 0.69 | 0.910 | |
| 5 | 0.17 | 0.35 | 0.54 | 0.735 | 0.915 |

When balancing a curved diaphragm BMR, this approach gives a good starting point. The masses are placed at the curved diaphragm modal mechanical admittance minima up to the highest eigenfrequency within the operational bandwidth and should initially be scaled off the voice coil assembly mass and their relative radial locations. Curved diaphragm modal mechanical admittance minima cannot be tabulated in a general form because these minima vary with different curvature profiles. Due to the manipulation of the nodal line locations, the masses of the mechanical impedance components must then be adjusted to achieve optimized inertial balancing.

Figure 6A:
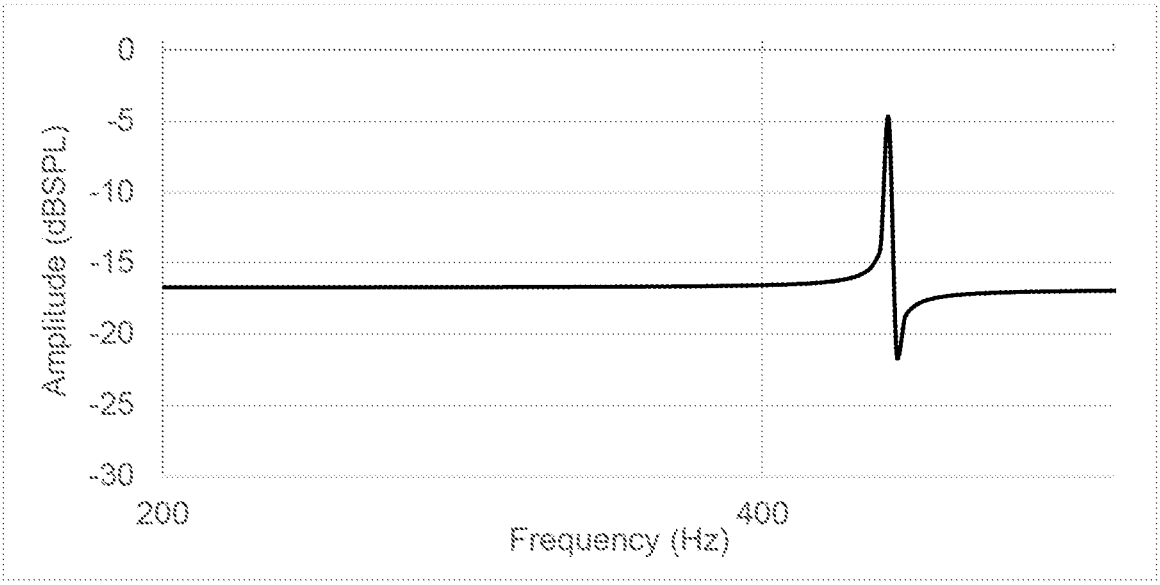
FIG. 6A is a graph illustrating the on-axis acoustic response of an unbalanced bending mode caused by excessive mass placed within a first nodal line for a balanced mode radiator in an embodiment.
Figure 6B:
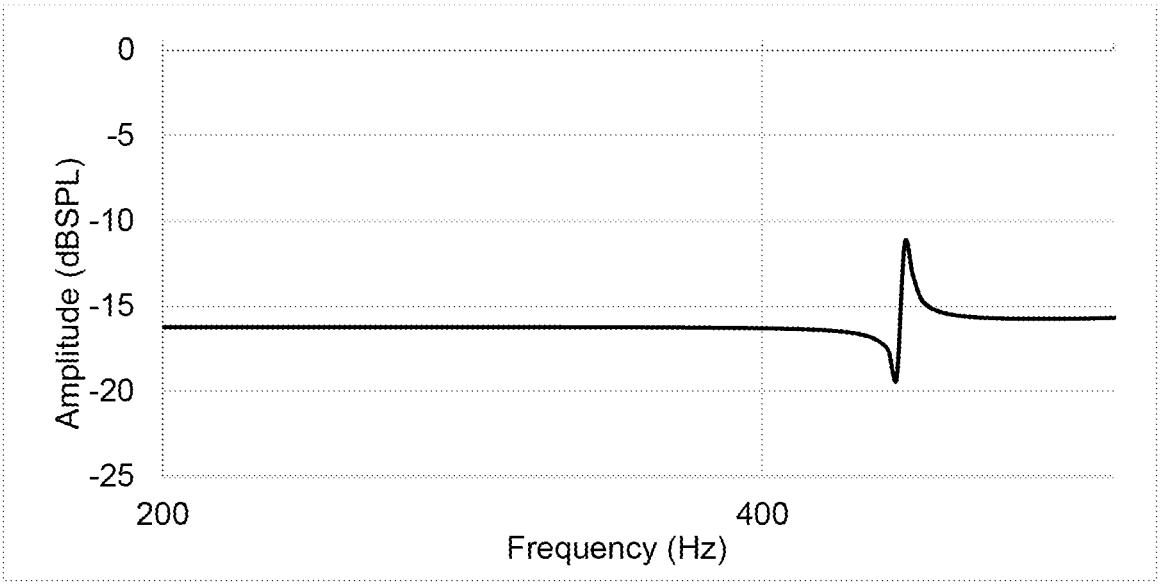
FIG. 6B is a graph illustrating the on-axis acoustic response of an unbalanced bending mode caused by excessive masses placed on the periphery of a first nodal line for a balanced mode radiator in an embodiment.

Starting with the lowest bending mode, mass adjustments can be made to correct each mode. For the first mode, if the masses within the area enclosed by the nodal line of the first bending mode are too large, the on-axis acoustic measurement will show a response akin to the response in FIG. 6A. If the masses on the periphery of the first bending mode's nodal line are too large, then the on-axis response will resemble FIG. 6B. Inertial balancing of the first mode may also be achieved by increasing the mass on the other side of the nodal line in either case, but excessive mass related efficiency loss is to be minimized when possible. The masses inside and outside the nodal line of the first bending mode can be adjusted until the on-axis response is as flat as possible and until the relative mean modal velocity of that mode is minimized.

A similar approach can be implemented to balance the second mode. However, the balancing of the first mode must be maintained. This is accomplished by scaling all the added masses up or down depending on how the diaphragm is unbalanced. Doing this preserves the radial moment that each mass applies about the nodal line and thus preserves its balancing. If further adjustment is required from multiple masses on either side of the nodal line of the first bending mode, then they should be adjusted so as to preserve the radial moment about the first mode. For the second mode, there are two nodal lines and the bending regions separated by the nodal lines have alternating polarity. As a result, the innermost and outermost regions have the same polarity. If the voice coil is within the middle region, and the masses are too low, then the acoustic response at the second mode will resemble the acoustic response shown in FIG. 6A. If the masses are too large, then the acoustic response will resemble the response shown in FIG. 6B.

For modes above the second mode, this method may still be used although implementation becomes significantly more difficult to maintain the inertial balancing of the lower order bending modes. If the diaphragm has a curved profile that consists of zero or one inflection points, the upper modes are minimally affected. The conventional flat diaphragm BMR balancing mass scheme should provide a low relative mean modal velocity and as a consequence any adjustments to the masses to balance the first and second mode should be minimized as much as possible. All mass adjustments should be made in no more than 10% increments and refined to 5% or lower when an approximate solution is found.

Figure 7A:
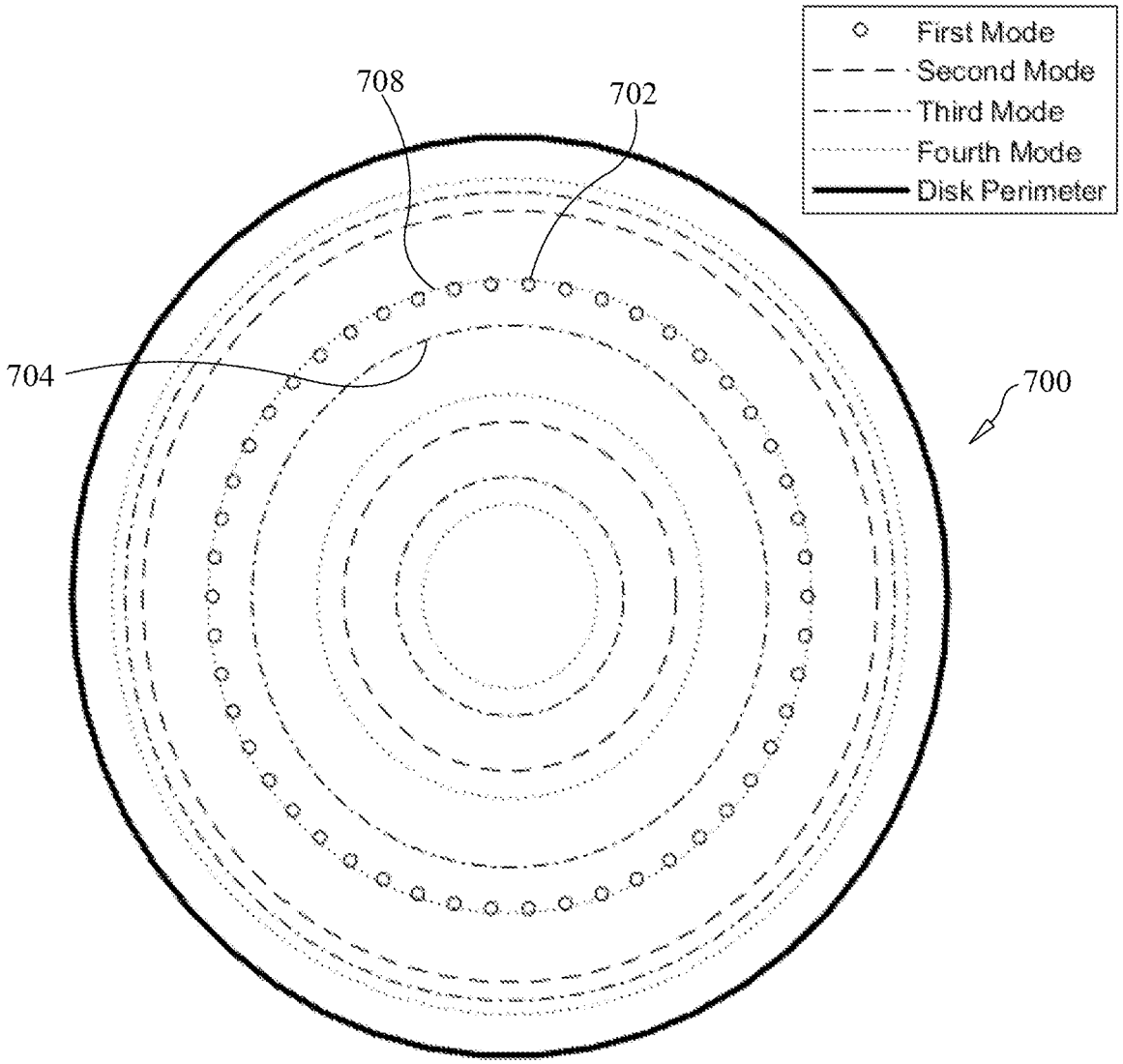
FIG. 7A is a plan view of a free flat circular diaphragm for a balanced mode radiator in an embodiment.

FIG. 7A is a plan view illustration of the distribution of nodal lines in a free, flat, circular diaphragm in an embodiment. In the illustrated embodiment 700, a series of lines are shown that represent the nodal line locations of the first four different bending modes present in the flat circular diaphragm of the BMR. The nodal line of a first bending mode is graphically illustrated with a single ring of circles 702, and the three nodal lines of a third bending mode 704 are illustrated with a series of dashes and dots. Each bending mode has nodal lines which are zones of zero translation, velocity, or acceleration due to modal excitation of the diaphragm. In essence, these are locations on the diaphragm that contribute little to no radiated acoustic power from bending mode operation. In the illustration, the nodal line of the first bending mode 702 is coincident with the third nodal line of the fourth bending mode 708. Generally, each of the bending modes of a flat diaphragm have different oscillation frequencies and different nodal line locations, and it is the combined or constructive radiating acoustic power of these bending modes that enables BMRs to radiate acoustic signals across a wide range of acoustic and ultrasonic frequencies concurrently with pistonic acoustic radiation. The motion of a BMR diaphragm is produced primarily from the electromotive driving force of a voice coil former activated by the interaction between a static magnetic field and the electrical current flowing through a voice coil that is wound about a voice coil former within a combined assembly comprising an electromechanical transducer. However, a performance advantage has been achieved by modifying the shape of BMR diaphragms in such a way that the nodal line locations can be shifted or adjusted by physically warping or creating a curved structure from a previously flat disk structure for a BMR diaphragm.

In attaining this performance advantage, the previously described process which was illustrated in FIGS. 3A and 3B is used to generate an optimal set of diaphragm shape parameters to generate a diaphragm profile having a curved shape, to iteratively evaluate the eigenfrequency output of curved diaphragm profiles, and to directly manipulate the distribution of bending modes of a chosen BMR diaphragm profile. When determined iteratively, the chosen diaphragm profile can produce an acoustic output with reduced acoustic distortion, with a reduced material cost measured in the form of smaller voice coils and smaller coil former diameters, and with less costly magnets for use in the electromechanical transducers that drive the diaphragms when compared to conventional flat diaphragm BMRs. Additionally, the smaller magnet sizes substantially reduce the overall weight, size and cost of the transducers that are used to drive the BMR diaphragms. Among the options for magnets, ceramic magnets can be used to further reduce costs, but can also lead to increased weight due to their significantly lower stored energy density than rare earth magnets.

Figure 7B:
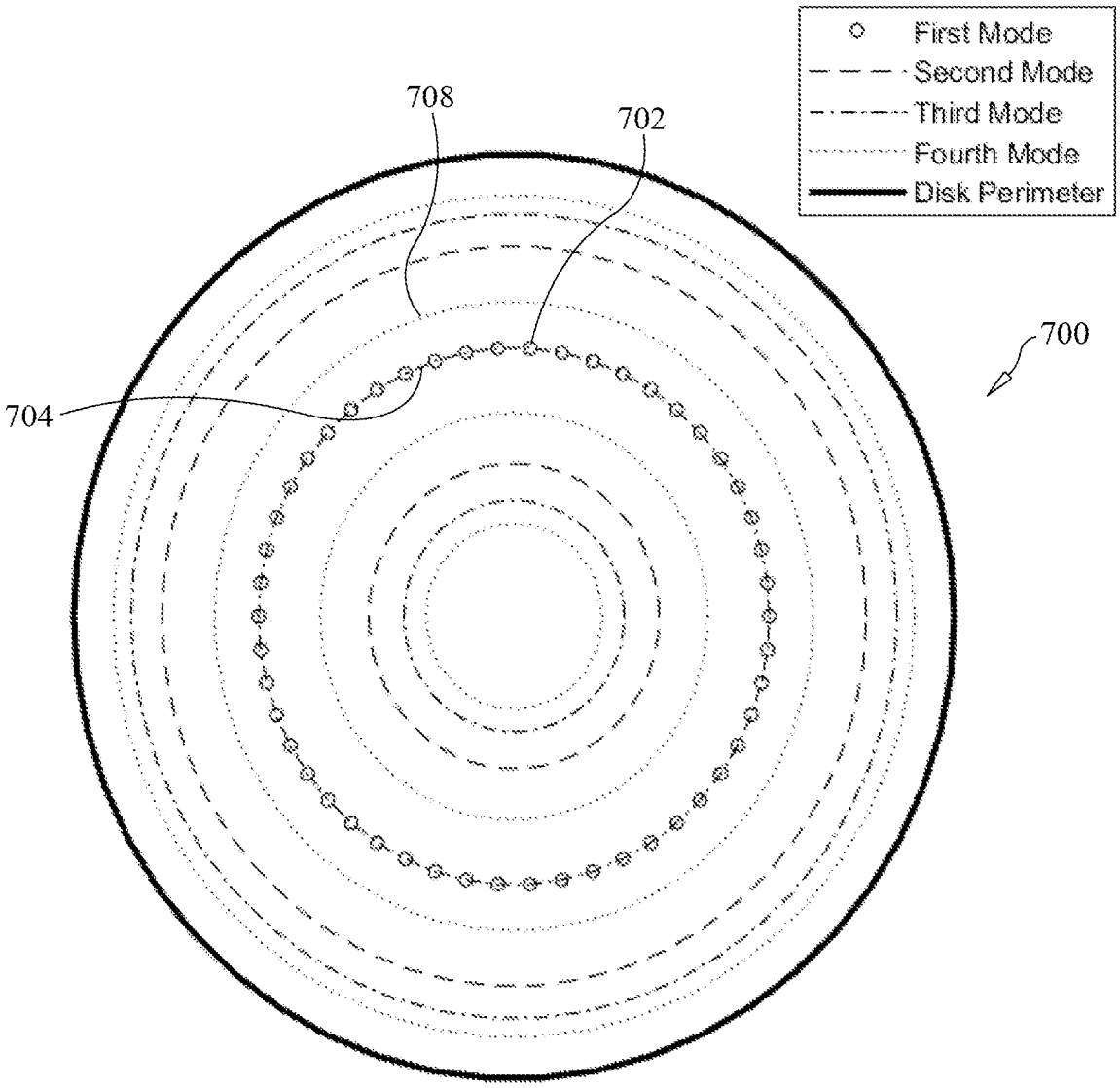
FIG. 7B is a plan view of a free curved circular diaphragm for a balanced mode radiator in an embodiment.

FIG. 7B is a plan view illustration of a curved, circular BMR diaphragm in an embodiment. In this illustrated embodiment, the curved shape of this alternative diaphragm profile has caused a shift of the first nodal line 702 of the first bending mode to be coincident with the second nodal line of the third bending mode 704. The ability to control and manipulate the shape of a BMR diaphragm achieved from the shifting of the bending modes provides functional advantages in terms of decreased signal directivity, reduced distortion, and ability to manufacture a BMR with reduced voice coil size. This reduced size substantially reduces the cost of materials for use as components in the electromechanical transducer. The structure modification enables lower distortion to be achieved from the availability of additional internal space to expand a spider element that provides a connection between the coil former and the stationary frame of a BMR. The expanded length of the spider element in a BMR arising from the curving of the diaphragm and corresponding reduction in internal component size enables more linear stiffness behavior in the spider thereby providing greater flexibility and a more significant reduction in distortion in the audio signal frequencies transmitted from the curved BMR diaphragm.

Figure 8A:
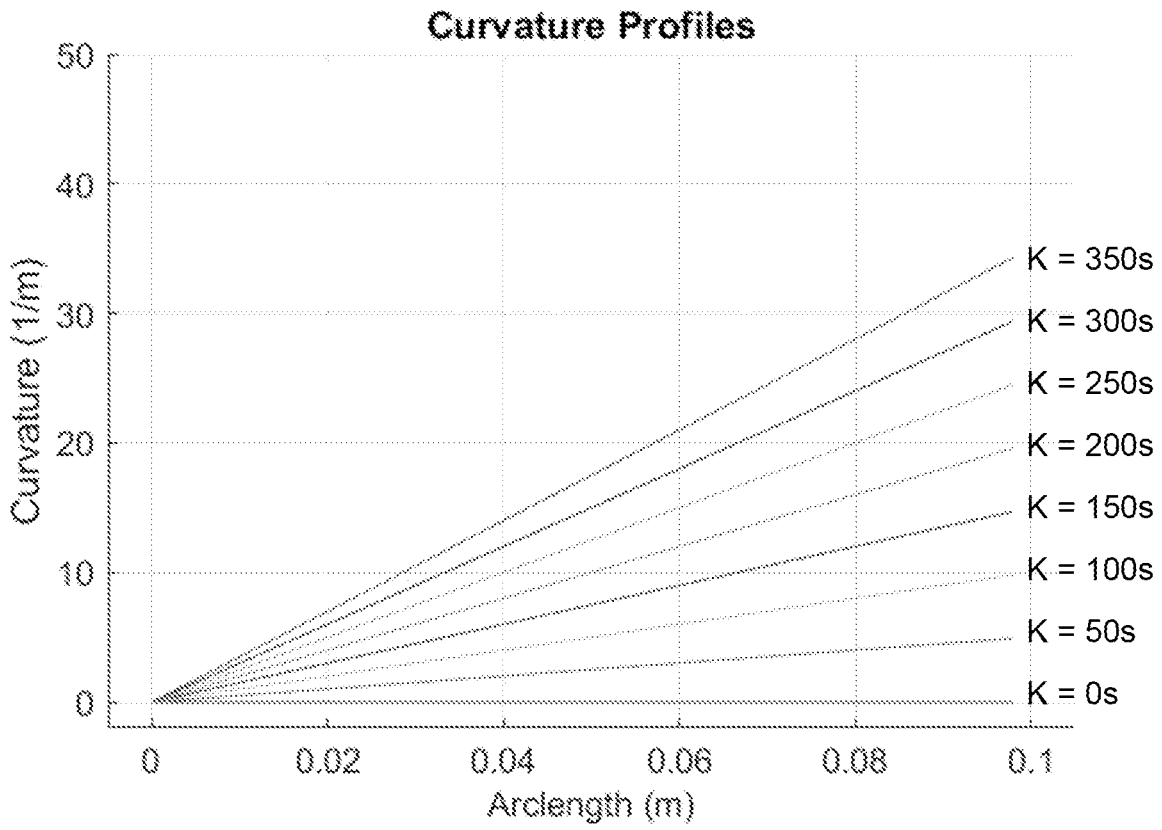
FIG. 8A is a graph illustrating curvature functions for diaphragm profiles for a balanced mode radiator in an embodiment.

FIG. 8A is an illustration of a representative set of curvature functions for use in creating curved BMR diaphragm profiles. Several lines are shown which present representative curvature relative to arc length for potential curved diaphragms for use in BMRs. From experimentation, it has been shown that a curvature K, defined as the product of curvature rate and arc length, satisfies the relationship K=250s, (where s represents arc length in meters and 250 represents the curvature rate in units of $1/m^2$), produces the optimal modification in the positioning of nodal line locations between the first bending mode and the third bending mode. In a diaphragm embodiment having this curvature profile the nodal line of the first bending mode of a BMR diaphragm has been made closely coincident with the location of a second nodal line of the third bending mode. When nodal line locations are made to be coincident or closely coincident, it has been found that applying a driving force on those nodal lines suppresses the excitation of the modes associated with those nodal lines thus achieving reduced distortion in acoustic output at those mode frequencies. Since the distortion from bending modes scales with surface velocity at the drive location, the lowest mode, if driven near an antinode (i.e., a point or line of maximum translation), has the highest surface velocity when compared to other bending modes. It therefore has the highest potential to generate acoustic distortion. Controlling the excitation of the first bending mode, through manipulation of its nodal line to be coincident or closely coincident with the drive location, generates a reduced output of acoustic radiation from that bending mode and minimizes acoustic distortion. In this manner, a form of inertial balancing called a "three-mode balance" may be implemented with nodal line redistribution through curvature of the diaphragm employed to reduce distortion at the frequency of the first bending mode. More specifically, the reduction in distortion is achieved from suppressing the modal velocity experienced by a voice coil by locating the diameter of a voice coil former at a diameter closely coincident with the nodal line of a bending mode. By making the nodal line of a first bending mode closely coincident with the nodal line of a higher order mode, the balanced modal behavior of a BMR can be more effectively maintained.

Figure 8B:
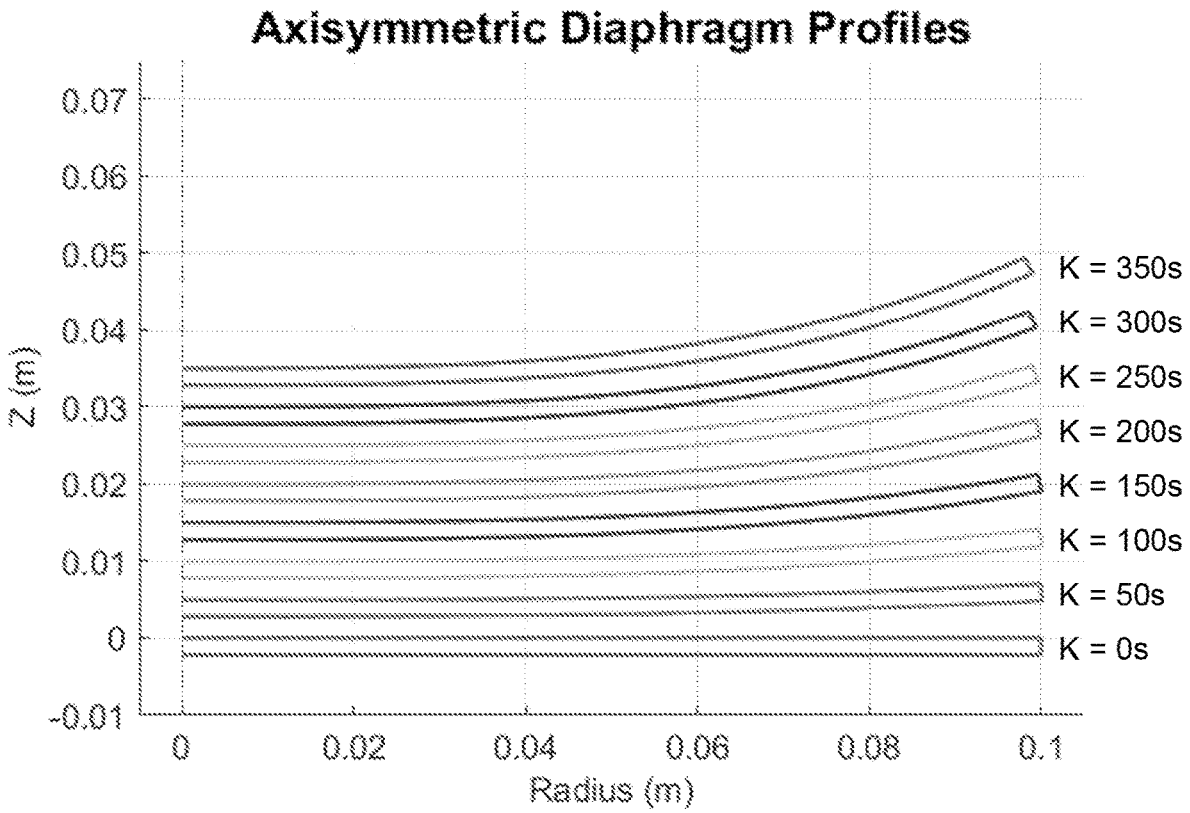
FIG. 8B is a graph illustrating axisymmetric diaphragm profiles for a balanced mode radiator in an embodiment.

FIG. 8B is a graph illustrating cross-sectional views of a range of axisymmetric diaphragm profiles for a BMR in an embodiment. In the graph, variations in the curvature of diaphragm profiles are presented. An advantageous embodiment has been found to be generated from a linear curvature rate of $250/m^2$ as the observed arc length moves outward from the center to the edge.

Figure 8C:
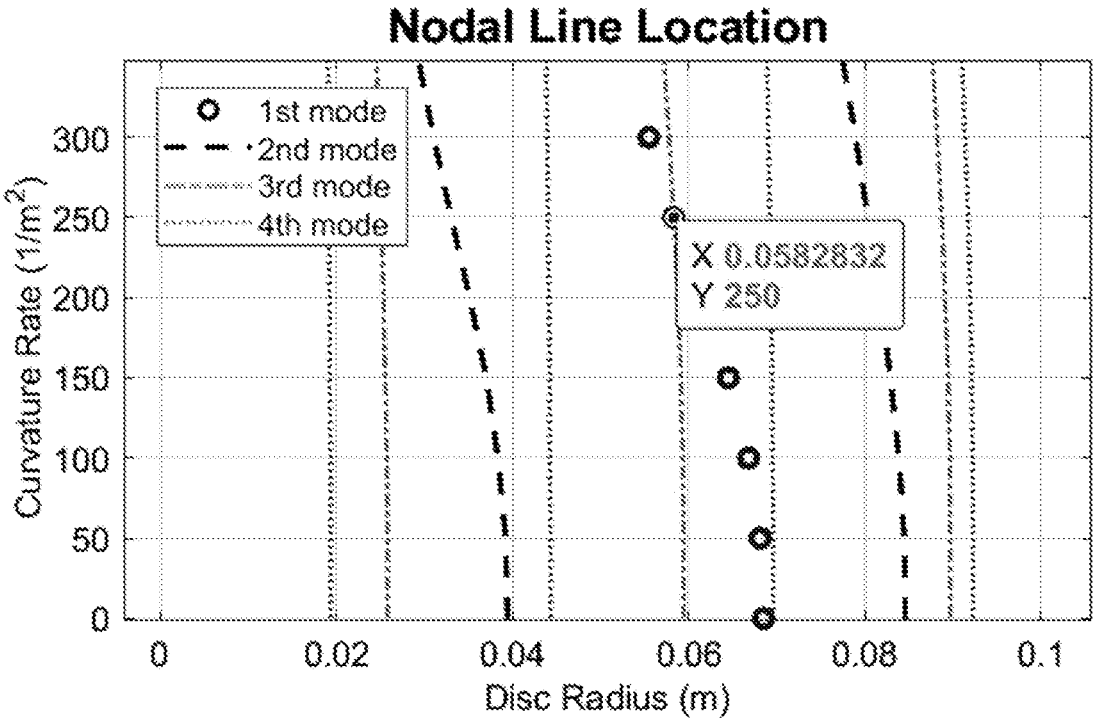
FIG. 8C is a graph illustrating nodal line locations on a diaphragm for a balanced mode radiator in an embodiment.

FIG. 8C is a graph illustrating the effect of curvature rate on nodal line location relative to diaphragm radius as measured in meters in this representative example for a 0.1-meter radius diaphragm. This graph illustrates how the curved profile of the diaphragm causes a shifting or modification in the position of lower order bending mode nodal line locations. In this case, a radial movement in the nodal line location of the first bending mode to be coincident with the second nodal line of the third bending mode is depicted.

Figure 8D:
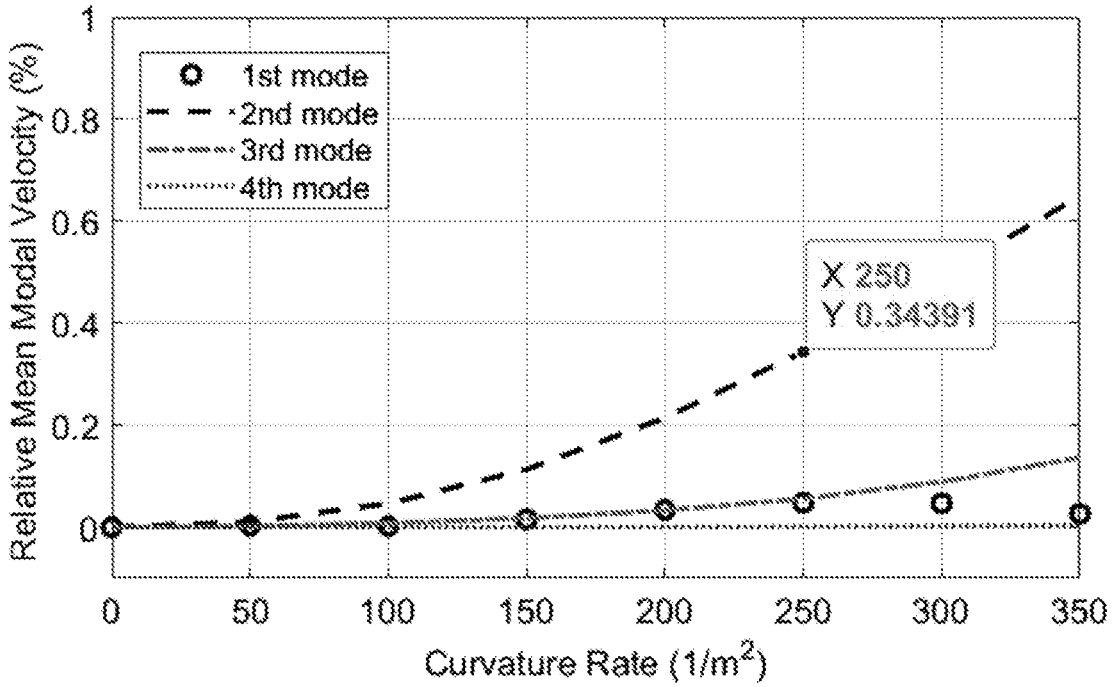
FIG. 8D is a graph comparing relative mean modal velocity to diaphragm curvature rate for a balanced mode radiator in an embodiment.

FIG. 8D is a graph illustrating relative mean modal velocity as a function of curvature rate of a curved diaphragm in an embodiment. This figure depicts in comparative form which bending modes interfere more strongly or less strongly with the acoustic output generated in the Z-direction from the surface of the pistonic component of the curved diaphragm operation. Relative mean modal velocity is determined by calculating the mean modal volume velocity and dividing it by the RMS modal volume velocity. A value lower than 25%, and preferably below 18%, indicates that the mode is inertially balanced. An optimal position has been identified and shown on the graph corresponding to a curved diaphragm where the curvature rate is $250/m^2$, and the relative mean modal velocity from this particular curved profile has first, third and fourth bending modes inertially balanced, thereby reducing interference with acoustic radiation generated from pistonic like motion, with sound radiating from the second bending mode, in the Z-direction, shown as roughly 0.34 to 0.35 percent of the RMS velocity of that bending mode. Bending modes with a low percentage of relative mean modal velocity radiate predominately off-axis and provide wide directivity.

Figure 9:
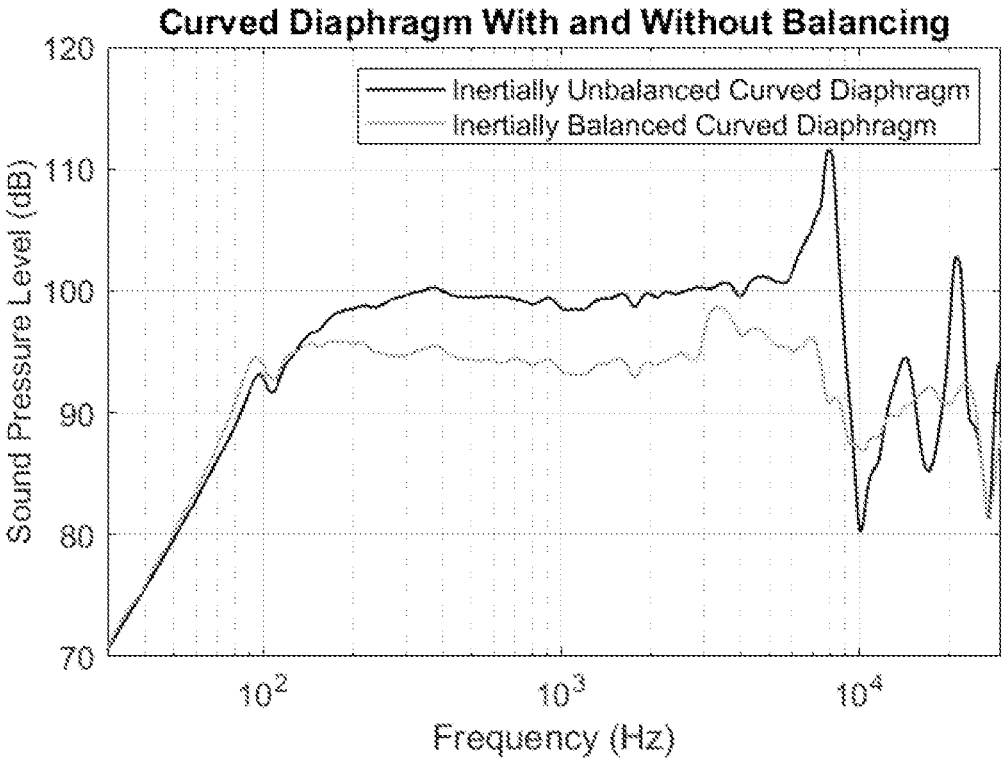
FIG. 9 is a graph illustrating the on-axis sound pressure levels for an embodiment of an inertially balanced curved diaphragm compared with an embodiment of an inertially unbalanced curved diaphragm.

FIG. 9 is a graph illustrating the on-axis sound pressure levels for an embodiment of an inertially balanced curved diaphragm compared with an embodiment of an inertially unbalanced curved diaphragm. A 0.2 mm thick diaphragm with a 40 mm diameter, and a relative edge height of 10% was used in both diaphragms. The curvature profile for both embodiments of the curved diaphragm was selected to provide a first nodal line location close to the location of a second nodal line location of the fourth mode, which corresponds to the placement location of a 19.05 mm diameter voice coil. By comparison, an inertially balanced flat 40 mm diameter diaphragm BMR would require a 27.6 mm voice coil diameter to suppress the excitation of the first bending mode. Suppression of the excitation of the first bending mode is desired to reduce the level of distortion present on radiated acoustic signals. The maximum relative mean modal velocity of the unbalanced curved diaphragm was 42%. After inertial balancing, the maximum relative mean modal velocity was decreased to 21% which is below the 25% inertial balancing threshold for a loudspeaker to be considered a BMR.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

What is claimed is:

1. A method for designing an inertially balanced audio transducer diaphragm, the method comprising:

receiving a plurality of input parameters for the diaphragm;

generating a first diaphragm shape based on the received plurality of input parameters;

performing a first frequency analysis of the first diaphragm shape;

determining a nodal line distribution of the first diaphragm shape based on the performed frequency analysis, the nodal line distribution comprising each resonant frequency of a plurality of vibrational bending modes resonating throughout the first diaphragm shape;

comparing the determined nodal line distribution with a desired nodal line distribution for the first diaphragm shape;

determining a relative error value from the comparing of the determined nodal line distribution with the desired nodal line distribution for the first diaphragm shape;

comparing the relative error value with a predetermined nodal line distribution tolerance limit; and generating a plurality of diaphragm shape parameters when the relative error value of the plurality of diaphragm shape parameters is below the predetermined nodal line distribution tolerance limit.

2. The method of claim 1 wherein the nodal line distribution comprises a plurality of locations of minimum translational velocity magnitude for each resonant frequency of the one or more vibrational bending modes resonating throughout the first diaphragm shape.

3. The method of claim 1 wherein the comparing of the relative error value with the predetermined nodal line distribution tolerance limit comprises:

adjusting iteratively the plurality of input parameters of the diaphragm when the relative error value is greater than the predetermined nodal line distribution tolerance limit; and generating an adjusted plurality of diaphragm shape parameters when the relative error value of the plurality of adjusted diaphragm shape parameters is below the predetermined nodal line distribution tolerance limit.

4. The method of claim 1 further comprising:

generating a simulated diaphragm based on the generated plurality of diaphragm shape parameters;

performing a second frequency analysis on the simulated diaphragm;

generating a modal mechanical admittance function for the simulated diaphragm based on the second frequency analysis;

determining a plurality of minima locations for the generated modal mechanical admittance function;

identifying a coupling location for a voice coil assembly and for each of one or more mechanical impedance components on a surface of a generated diaphragm based on the simulated diaphragm; and coupling the voice coil and the one or more mechanical impedance components to the surface of the generated diaphragm at each of the identified coupling locations, wherein the generated diaphragm including the coupled voice coil and the one or more mechanical impedance components comprises an inertially balanced audio transducer diaphragm.

5. The method of claim 4 wherein the first frequency analysis is an eigenfrequency analysis of the first diaphragm shape, wherein the second frequency analysis is an eigenfrequency analysis of the simulated diaphragm, wherein the performed second frequency analysis comprises identifying a highest vibrational bending mode frequency in a target operational bandwidth of the diaphragm, and wherein the generating of the modal mechanical admittance function for the simulated diagram is performed using the identified highest vibrational bending mode frequency in the target operational bandwidth.

6. The method of claim 4 wherein the coupling location of the voice coil assembly is coincident with a nodal line of a first vibrational bending mode within the predetermined nodal line distribution tolerance limit.

7. The method of claim 1 the plurality of input parameters includes one or more parameters defining a curvature profile for the diaphragm.

8. The method claim 7 wherein the plurality of input parameters includes at least a curvature function and an arc length of the diaphragm for the defining of the curvature profile define a curvature function and an arc length.

9. A method of making an electrodynamic transducer diaphragm, the method comprising:

generating a curvature profile for the diaphragm;

determining a modal mechanical admittance for the diaphragm based on the generated curvature profile;

determining one or more locations on a surface of the diaphragm for a voice coil assembly and one or more inertial balancing masses based on the determined modal mechanical admittance for the diaphragm;

mounting the voice coil assembly and one or more inertial balancing masses on the surface of the diaphragm at the determined one or more locations;

measuring a modal velocity of the diaphragm having the mounted voice coil assembly and one or more inertial balancing masses;

determining a relative mean modal velocity of the diaphragm from the measured modal velocity of the diaphragm;

adjusting the masses of the one or more inertial balancing masses until the determined relative mean modal velocity is within a relative man modal velocity limit.

10. The method of claim 9 wherein the generating of the curvature profile is based on a plurality of diaphragm shape parameters including at least a curvature function and an arc length.

11. The method of claim 9 wherein the relative mean modal velocity limit is less than one of 18% or 25%.

12. The method of claim 9 wherein the determining of the one or more locations on the surface of the diaphragm for the voice coil assembly and one or more inertial balancing masses comprises:

determining each mechanical admittance function for each vibrational bending mode of the diaphragm;

determining a highest frequency vibrational bending mode within an operational bandwidth of the diaphragm;

determining the modal mechanical admittance function of the determined highest frequency vibrational bending mode within the operational bandwidth of the diaphragm;

identifying one or more minima locations of the modal mechanical admittance function; and evaluating a closeness of match between a measured velocity mean value of the diaphragm and a pistonic velocity of the diaphragm within the operational bandwidth range.

13. An audio device comprising:

a diaphragm having a curved profile adapted for radiation of audio signals from a plurality of bending modes and a piston mode, each of the bending modes having one or more nodal lines, at least one nodal line from a first bending mode of the plurality of bending modes ebbing coincident with a nodal line from one or more of the other bending modes in the plurality of bending modes, the diaphragm having a frontal side and a rear side; and a transducer coupled to the rear side of the diaphragm, the transducer adapted for driving the diaphragm for radiation of audio signals having reduced audio distortion, the transducer comprised of one or more magnets, a pole piece, a back plate, a front plate, a coil former, a voice coil, and at least one suspension element, wherein the plurality of bending modes each have one or more minima locations throughout the diaphragm, wherein the transducer is mounted on one of the one or more minima locations of the plurality of bending modes and one or more impedance components are mounted on at least one of the remaining one or more minima locations to inertially balance the diaphragm based on a pre-determined relative modal velocity limit, and wherein a driving force applied to the diaphragm using the voice coil of the transducer produces the radiation of the audio signals turn the plurality of bending modes and the piston mode, each of the radiated audio signals having a measurable distortion component, the measurable distortion component of a first-lowest frequency bending mode from the plurality of bending modes being less than a distortion component of a second-lowest frequency bending mode from the plurality of bending modes, wherein the voice coil is mounted at a location on the rear side of the diaphragm that is coincident with a nodal line location of the first-lowest frequency bending mode of the plurality of bending modes.

14. The audio device of claim 13 wherein the plurality of bending modes is within an operational bandwidth of the diaphragm.

15. The audio device of claim 13 wherein the first suspension element is a roll surround suspension element.

16. The audio device of claim 15 further comprising a second suspension element, the second suspension element being one of a corrugated textile, a flexible armature, or a second roll surround suspension element.

17. The audio device of claim 13 wherein the pre-determined relative mean modal velocity limit is less than one of 18% or 25%.

18. The audio device of claim 13 wherein a thickness of a curved profile of the diaphragm is less than 5% of a radius of the diaphragm.

* * * * *